US006217141B1

(12) United States Patent
Nakamura et al.

(10) Patent No.: US 6,217,141 B1
(45) Date of Patent: Apr. 17, 2001

(54) METHOD OF DRIVING PIEZO-ELECTRIC TYPE INK JET HEAD

(75) Inventors: Shigeyoshi Nakamura; Hiroshi Nou; Satoshi Semba; Tomohisa Mikami, all of Kawasaki (JP)

(73) Assignee: Fujitsu Limited, Kawasaki (JP)

( * ) Notice: Subject to any disclaimer, the term of this patent is extended or adjusted under 35 U.S.C. 154(b) by 0 days.

(21) Appl. No.: 08/868,832

(22) Filed: Jun. 9, 1997

(30) Foreign Application Priority Data

Jun. 11, 1996 (JP) ..... 8-148800

(51) Int. Cl.[7] ..... B41J 29/38
(52) U.S. Cl. ..... 347/10
(58) Field of Search ..... 347/9, 10, 14, 347/11, 16

(56) References Cited

U.S. PATENT DOCUMENTS

| | | | | |
|---|---|---|---|---|
| 4,617,580 | * | 10/1986 | Miyakawa | 347/14 X |
| 4,714,935 | | 12/1987 | Yamamoto et al. | 346/140 |
| 4,897,665 | * | 1/1990 | Aoki | 347/10 |
| 5,221,931 | | 6/1993 | Moriyama | 346/1.1 |
| 5,576,743 | * | 11/1996 | Momose | 347/11 |
| 5,631,675 | * | 5/1997 | Futagawa | 347/10 |

FOREIGN PATENT DOCUMENTS

| | | |
|---|---|---|
| 0 437 106 A3 | 7/1991 | (EP) . |
| 0 616 891 A1 | 9/1994 | (EP) . |
| 2-006137 | 1/1990 | (JP) . |
| 8-058116 | 3/1996 | (JP) . |

* cited by examiner

*Primary Examiner*—William J. Royer
(74) *Attorney, Agent, or Firm*—Armstrong, Westerman, Hattori, McLeland & Naughton, LLP

(57) ABSTRACT

Disclosed is a method of driving a piezo-electric type ink jet head for jetting inks out of a nozzle by making use of a distortion of a piezo-electric element. The driving method includes a first step of driving the piezo-electric element so that a meniscus of inks is receded from an initial position of the nozzle to a first position within the nozzle, a second step of driving the piezo-electric element so that the meniscus quickly advances from the first position to a second position within the nozzle, and a third step of driving the piezo-electric element so that the meniscus slowly advances from the second position to the initial position. A particle quantity of ink particles is changed by changing a movement quantity from the first position to the second position in the second step.

25 Claims, 23 Drawing Sheets

FIG.6

| LEVEL | V5 (VOLT) | t1 (μs) | t2 (μs) | V4/V5 | t4 (μs) | VOLUME (pel) |
|---|---|---|---|---|---|---|
| 1 | 43.5 | 80 | 6 | 1.0 | 0 | 56 |
| 2 | 43.5 | 70 | 3 | 0.7 | 22 | 31 |
| 3 | 43.5 | 60 | 1 | 0.5 | 24 | 12 |
| 4 | 43.5 | 50 | 1 | 0.46 | 24 | 5 |

SMALL (INK QUANTITY RESTRAINED) ← INK QUANTITY → LARGE (NORMAL PRINT CONDITION)

SMALL (INK QUANTITY RESTRAINED) ← INK QUANTITY → LARGE (NORMAL PRINT CONDITION)

Toward Nozzle outlet

Toward Pressure chamber

METHOD OF DRIVING PIEZO-ELECTRIC TYPE INK JET HEAD

BACKGROUND OF THE INVENTION

1. Field of the Invention

The present invention relates generally to a method of driving a piezo-electric type ink jet head for jetting an ink out of a nozzle by making use of a distortion of a piezo-electric element and, more particularly, to a method of driving a piezo-electric type ink jet head for changing a quantity of ink particles jetted out.

2. Description of the Related Art

Ink jet printers are used for apparatuses such as a printer, facsimile and so on. There has been availed a piezo-electric type ink jet printer using a piezo-electric element among those ink jet printers. The piezo-electric type ink jet printer is constructed to jet inks out of a nozzle by making use of a distortion of the piezo-electric element.

In this type of ink jet printer, a print dot diameter is required to be variable to express gradations of a print. For this purpose, changing a quantity of ink particles to be jetted is requested of the above printer.

A method of jetting the inks is classified into a positive polarity drive method of sucking the inks after jetting out the inks, and a negative polarity drive method of jetting out the inks after sucking the inks. According to the negative polarity drive method, a scatter of the ink particles is stable, and a possible-of-getting-particled frequency is broad.

FIGS. 25A–25D and FIGS. 26A–26E are explanatory diagrams showing a first prior art.

A d31-mode is a mode making most of a distortion caused when the piezo-electric element shrinks upon an application of a positive voltage. In this mode, the piezo-electric element is distorted in a perpendicular direction for an electric-field direction. In this d31-mode, when a voltage indicated by a dotted line in FIG. 25A is applied to the piezo-electric element, operation of jetting the inks is performed after sucking the inks.

FIGS. 26A–26E are enlarged views of the nozzle. A meniscus 10 is formed in a nozzle 1. Herein, a velocity vector the meniscus has is expressed by "V".

FIG. 26A shows a state of how the nozzle 1 and the meniscus 10 might be when the piezo-electric element is in an initial state. A surface tension of the meniscus 10 equibrates with a negative within the pressure chamber, and the meniscus 10 exists in an initial position in the vicinity of a nozzle outlet.

FIG. 26B shows a position. of the meniscus 10 when increasing the negative pressure in the pressure chamber by letting the piezo-electric element shrink in such a direction as to expand the pressure chamber. That is, it shows a case where a positive voltage having a positive inclination is, as indicated by a dotted line in FIG. 25A, applied thereto. The negative pressure in the pressure chamber gets larger than the surface tension of the meniscus 10, and the meniscus 10 is receded toward the pressure chamber.

FIG. 26C shows a position when the negative pressure in the pressure chamber is reduced due to an influx of the inks from an ink supply port enough to reduce the negative pressure in the pressure chamber and the meniscus 10 is substantially stopped. At this time, the meniscus 10 is forced to move back to the vicinity of the pressure chamber.

FIG. 26D shows a position of the meniscus 10 when the piezo-electric element is abruptly expanded in such a direction as to contract the pressure chamber. That is, it shows a case where a voltage having a negative inclination is, as indicated by a dotted line in FIG. 25A, applied thereto. The meniscus 10 forms a layer flow by dint of a positive pressure within the pressure chamber and the surface tension of the meniscus, and has a larger velocity toward the nozzle outlet. Accordingly, the meniscus 10 quickly moves toward the nozzle outlet.

FIG. 26E shows a state of the meniscus 10 when the expansion of the piezo-electric element is stopped. The pressure in the pressure chamber becomes a large negative pressure due to a flux of the inks to the ink supply port as well as to the nozzle 1. Therefore, the inks in the nozzle 1 are abruptly decelerated. The ink liquid outside the nozzle has, however, a velocity enough to scatter out and hence overwhelms the surface tension given from the inks of the nozzle 1, thereby getting particled. Thereafter, the inks having an insufficient velocity are forced to return inside the nozzle 1 by dint of the surface tension.

The states described above are repeated, thereby forming the ink particles and jetting them out.

Known as a first prior art method of controlling the particle quantity of the ink particles is a method of decreasing a voltage amplitude applied to the piezo-electric element down to V2 as indicated by a solid line in FIG. 25A. The particle quantity of the ink particles can be reduced by this method. FIGS. 25B through 25D show a state of how the nozzle 1 and the meniscus 10 might be when jetting the small ink particles.

FIG. 25B shows a state when starting a suction of the inks. The meniscus 10 is moving toward the pressure chamber.

FIG. 25C shows a state of how the nozzle 1 and the meniscus 10 might be when finishing the suction of the inks and starting the jet-out of the inks. Since an amplitude of the voltage applied to the piezo-electric element is reduced, a recession quantity of the meniscus becomes smaller than in the case of FIG. 26*c*.

FIG. 25D shows a state of how the nozzle 1 and the meniscus 10 might be when the ink liquid gets particled. As the recession quantity of the meniscus 10 has been decreased, the ink particle quantity also decreases.

A second prior art method of controlling the ink particle quantity will be explained with reference to FIGS. 27A through 27D.

According to the second method, the ink particle quantity is reduced by changing a receding velocity of the meniscus. Along with this, a jetting speed is controlled. More specifically, as indicated by a solid line in FIG. 27A, a drive voltage for the piezo-electric element remains unchanged, and a rising slope of the drive voltage is made steep. The particle quantity of the ink particles becomes smaller as this slope gets steeper and steeper. Note that the drive waveform in the case of generating a normal quantity of ink particles is shown by the dotted line as in FIG. 25A.

FIG. 27B shows a state of how the nozzle 1 and the meniscus 10 might be when starting the suction of the inks. At this time, a higher velocity toward the pressure chamber is given to the meniscus 10 by quickly sucking the inks than in the case of jetting a normal quantity of the ink particles (as indicated by the dotted line in FIG. 27A). Then, the meniscus 10 is forced to move to the vicinity of the pressure chamber.

FIG. 27C shows a state of how the nozzle 1 and the meniscus 10 might be when starting the jet-out of the inks upon finishing the suction of the inks. The meniscus 10 is receded to the vicinity of the pressure chamber in the nozzle 1 by the suction of the inks, and therefore the inks can be accelerated enough.

FIG. 27D shows a state of how the nozzle 1 and the meniscus 10 might be when the ink liquid gets particled. The ink liquid having the sufficient velocity gets particled and thereafter scatter out.

A third prior art method of controlling the ink particle quantity will be described referring to FIGS. 28A through 28D.

According to the third method, as indicated by a solid line in FIG. 28A, the drive voltage is reduced down to V2 as in the first prior art method, and the recession quantity of the meniscus when sucking the inks is decreased. Along with this, a voltage changing velocity when jetting the inks is made much higher, thereby preventing the meniscus from decreasing in its velocity when jetting the inks.

FIG. 28B shows a state of how the nozzle and the meniscus might be when starting the suction of the inks. FIG. 28C shows a state of how the nozzle and the meniscus might be when finishing the suction of the inks. The voltage amplitude is reduced, and hence the meniscus 10 is not receded to the vicinity of the pressure chamber. Herein, as described above, the inks are quickly jetted out. At this moment, the inks in close proximity to the nozzle outlet are jetted out while being incapable of obtaining the sufficient velocity. Those inks are, however, mixed with forthcoming inks that are enough accelerated and become the ink particles having a desired velocity on the whole.

FIG. 28D shows a state of how the nozzle and the meniscus might be when the ink liquid gets particled. The sufficiently accelerated ink liquid get particled and thereafter scatter out.

The third method is intended to compensate a drop in the velocity that is caused due to the reduction in the recession quantity of the meniscus.

There arise, however, the following problems inherent in the first prior art method.

The ink liquid is, while existing in the nozzle, pushed by the positive pressure in the pressure chamber and can be accelerated. Once the ink liquid is jetted out of the nozzle outlet, however, the ink liquid can not be accelerated much higher than it. Therefore, as done by this method, if the recession quantity of the meniscus 10 is reduced, some ink liquid existing in the vicinity of the nozzle outlet in the intra nozzle ink liquid is jetted out of the nozzle outlet while not being sufficiently accelerated.

For this reason, the ink liquid does not reach a target velocity and is not accelerated. Thereafter, the ink liquid, which has not been accelerated, is mixed with the forthcoming ink liquid having the sufficient velocity. However, the layer flow state disappears, and hence the direction of a velocity vector of the ink particles is disturbed. This leads to a decline in terms of a scatter stability. In combination with this, a kinetic energy is lost by the mixture of the ink liquids, whereby the average ink particle velocity slows down. This might cause a disturbance in a printed image.

Further, the second prior art method presents the problems which follow.

Just when the meniscus 10 is abruptly receded, the pressure in the pressure chamber is changed to the positive pressure, and therefore, as shown in FIG. 27D, a velocity distribution in radial direction of the nozzle is disturbed. This results in a disturbance in the scattering direction of the ink particles. Therefore, in the drive waveform shown in FIG. 27A, a time Trb can not be shortened enough, so that a variation width of the particle quantity of the ink particles can not be taken large.

Moreover, the third prior art method has the following problems.

(1) As in the case of the first prior art method, since the recession quantity of the meniscus is reduced, the scattering direction of the ink particles is disturbed.

(2) An increase in the variation width of the particle quantity of the ink particles entails a quick enhancement of the velocity of the meniscus when jetted out. Even if the velocity of the meniscus when jetted out is quickly increased, however, the velocity of the meniscus when jetted out is restricted by a natural frequency of the piezo-electric element. Therefore, the variation width of the particle quantity of the ink particles can not be taken large.

(3) If the velocity of the meniscus when jetted out is quickly increased, an overshoot of the piezo-electric element enlarges, and a large quantity of satellite particles are produced. This might cause a decline in terms of the print quality, with result that the variation width of the particle quantity of the ink particles can not be taken large.

SUMMARY OF THE INVENTION

It is a primary object of the present invention to provide a method of driving a piezo-electric type ink jet head, by which a variation width of a particle quantity of ink particles can be taken large.

It is another object of the present invention to provide a method of driving a piezo-electric type ink jet head, by which the variation width of the particle quantity of the ink particles can be taken large, and a velocity of the ink particles can be prevented from decreasing.

It is still another object of the present invention to provide a method of driving a piezo-electric type ink jet head, by which the variation width of the particle quantity of the ink particles can be taken large, and a scatter of the ink particles can be prevented from being disturbed.

According to the present invention, there is provided a method of driving a piezo-electric type ink jet head, having a pressure chamber for reserving inks, a nozzle for jetting out ink particles from the pressure chamber and a piezo-electric element for supplying the pressure chamber with a pressure for jetting out the ink particles, for changing a particle quantity, i.e., volume of the ink particles to be jetted. The driving method comprises a first step of driving the piezo-electric element so that a meniscus of inks is receded from an initial position of the nozzle to a first position within the nozzle, a second step of driving the piezo-electric element so that the meniscus quickly advances from the first position to a second position within the nozzle, and a third step of driving the piezo-electric element so that the meniscus slowly advances from the second position to the initial position, i.e., the meniscus advances more slowly in the third step than in the second step.

According to the present invention, a movement quantity of the meniscus when sucking the inks is fixed. Then, a particle quantity of the ink particles is varied by controlling the movement quantity when abruptly moving the meniscus toward a nozzle outlet at the time of jetting the inks.

According to the present invention, the movement quantity of the meniscus when sucking the inks is fixed, and it is therefore feasible to prevent a disturbance of scatter and a decrease in velocity, which are derived from a prior art method of changing a suction quantity of the meniscus.

Further, the movement quantity in the case of abruptly moving the meniscus toward the nozzle outlet when jetting the inks, is controlled, and hence an abrupt voltage variation is not required unlike the prior art. Therefore, a variation width of the particle quantity of the ink particles can be taken large.

Other features and advantages of the present invention will become readily apparent from the following description taken in conjunction with the accompanying drawings.

BRIEF DESCRIPTION OF THE DRAWINGS

The accompanying drawings, which are incorporated in and constitute a part of the specification, illustrate presently preferred embodiments of the invention, and together with the general description given above and the detailed description of the preferred embodiments given below, serve to explain the principle of the invention, in which:

FIG. 6 is a chart showing a characteristic in the second embodiment shown in FIGS. 5A, 5B and 5C;

DETAILED DESCRIPTION OF THE PREFERRED EMBODIMENTS

Figure 2:
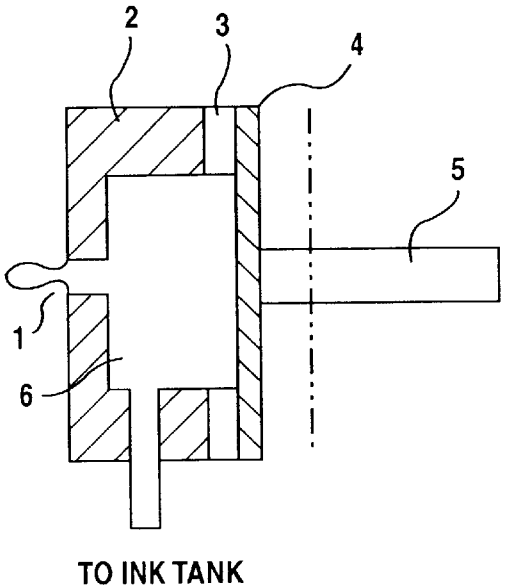
FIG. 2 is a diagram illustrating a construction of an ink jet head used for the present invention.
Figure 1:
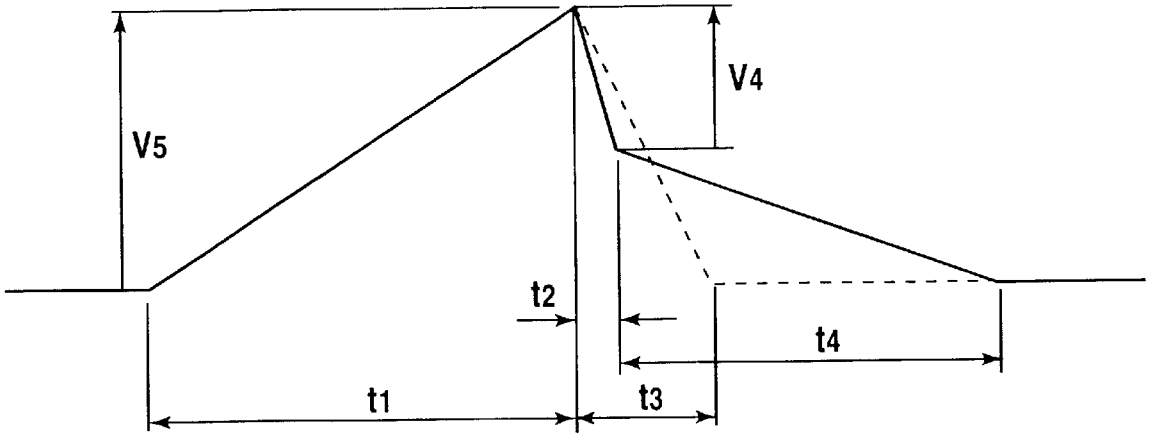
FIG. 1 is an explanatory diagram showing a first embodiment of the present invention.

FIG. 1 is an explanatory diagram showing a first embodiment of the present invention. FIG. 2 is a view illustrating a construction of an ink jet head. FIGS. 3A through 3D are explanatory diagrams showing operations in the first embodiment of the present invention.

To start with, the construction of the ink jet head will be explained with reference to FIG. 2. A nozzle 1 jets out inks. A nozzle plate 2 forms the nozzle 1 and constitutes walls by which a pressure chamber 6 is defined. An elastic member 3 is provided between the nozzle plate 2 and a pressure plate 4 and exhibits elasticity. The pressure plate 4 transfers a force generated by a piezo-electric element 5 into the pressure chamber 6. The piezo-electric element 5 is provided on the pressure plate 4 and displaced by an application of a voltage. The pressure chamber 6 pressurizes the inks. The pressure chamber 6 communicates with the nozzle 1 and is connected to an ink tank.

This piezo-electric element 5, upon an application of a positive voltage, shrinks and operates in a d31-mode. Then, the piezo-electric element 5 is driven with a negative polarity.

Next, the first embodiment will be discussed referring to FIGS. 1 and 3A through 3D.

FIG. 1 shows a drive waveform of the piezo-electric element 5. A dotted line in FIG. 1 indicates a drive waveform when jetting out a normal quantity of ink particles. A solid line in FIG. 1 indicates a drive waveform when jetting out a relatively small quantity of ink particles. Note that FIGS. 3A through 3D are explanatory diagrams showing operations in the case of the solid line waveform in FIG. 1.

Figure 3A:
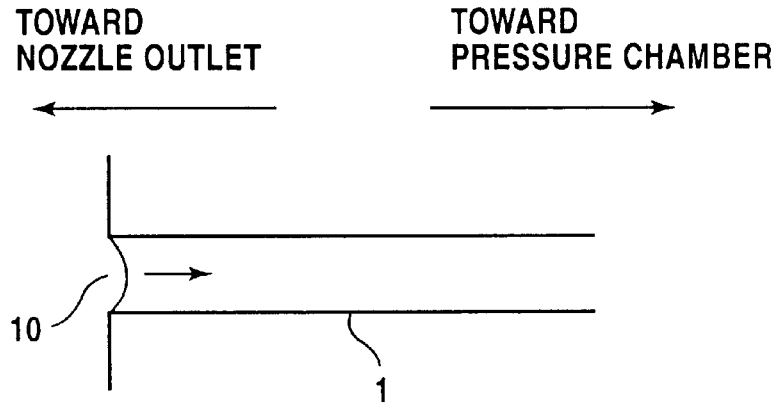
FIGS. 3A, 3B, 3C and 3D are explanatory diagrams showing an operation in the first embodiment of the present invention.

FIG. 3A shows a state of how the nozzle and a meniscus might be when the meniscus starts moving toward the pressure chamber from an initial position. At this time, as shown in FIG. 1, a first drive voltage having an inclination, i.e., oblique, in a positive direction is applied to the piezo-electric element 5. With this voltage application, the piezo-electric element 5 shrinks, whereby a negative pressure is produced within the pressure chamber 6. The meniscus is moved back toward the pressure chamber from the initial position.

Figure 3B:
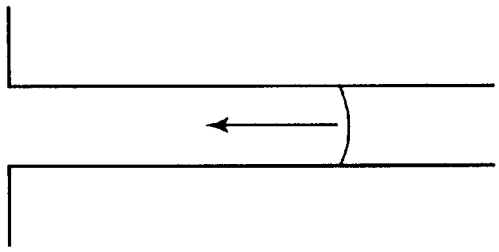

FIG. 3B shows a state of how the nozzle and the meniscus might be when the meniscus starts quickly moving toward an outlet of the nozzle 1 immediately after the piezo-electric element 5 has switched over to an expansion from the contraction. More specifically, as shown in FIG. 1, after the first drive voltage having the positive inclination has been applied to the piezo-electric element 5 for a time t1, a second drive voltage having a negative steep inclination is applied thereto. The drive voltage exhibiting the positive inclination comes to have a drive voltage value on the order or V5 after the above-mentioned time t1 has elapsed. A maximum value of the drive voltage having the positive inclination is the same as that in the case of jetting out the ink particles having a normal particle size as indicated by the dotted line in the Figure. Accordingly, the meniscus is moved back to a first predetermined position within the nozzle 1. A quantity of this recession is the same as that in the case of jetting out the ink particles having the normal particle size.

Further, the piezo-electric element 5 is, upon applying the second drive voltage having the negative inclination thereto, switched over to the expansion. The meniscus is thereby quickly moved toward the outlet of the nozzle 1.

Figure 3C:
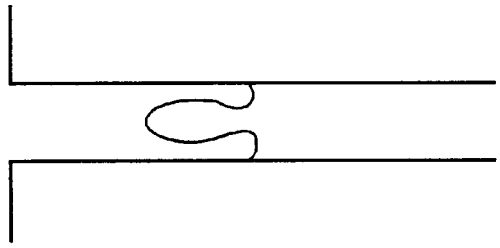

FIG. 3C illustrates a state of how the nozzle and the meniscus might be in the case of abruptly decreasing a velocity of the expansion of the piezo-electric element 5 just when the meniscus reaches a second position within the nozzle. To be more specific, as shown in FIG. 1, the second drive voltage having the negative steep inclination is applied to the piezo-electric element 5 for a time t2. A potential difference of the second drive voltage is V4. Then, after the time t2 has elapsed, the voltage is changed to a third drive voltage having a negative gentle inclination. The piezo-electric element 5 is thereby abruptly decreased in terms of the expanding velocity.

In this state, a small quantity of inks existing at an edge of the meniscus within the nozzle 1 are sufficiently accelerated. Then, the ink liquid posterior thereto within the nozzle 1 comes to a state of being abruptly decelerated. Therefore, the ink liquid in the vicinity of the meniscus starts getting particled.

Figure 3D:
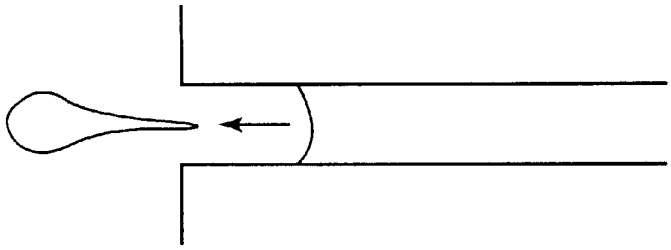

FIG. 3D shows a state of how the nozzle and the meniscus might be when the piezo-electric element 5 stops its expansion. More specifically, it is a state after a third drive voltage has been applied for a time t4. In this state, the small quantity of ink liquid accelerated enough steers clear of a surface tension and gets particled. Further, the inks inside the nozzle 1 are temporarily forced to move inside the nozzle by the negative pressure in the pressure chamber 6 that is produced due to an ink flux to an ink supply port and the nozzle 1. Thereafter, the inks return to the vicinity of the nozzle outlet due to the surface tension.

Thus, when changing a particle quantity of the ink particles, a change in the quantity of recession of the inks is not permitted. Therefore, the ink liquid can be sufficiently accelerated within the nozzle. Then, a moving quantity from the first position to the second position is changed by changing the potential difference V4 till the expansion velocity of the piezo-electric element 5 is abruptly decreased since the abrupt expansion thereof was started. The ink particles, the quantity of which corresponds to the moving quantity, can be thereby generated.

Then, the velocity can be also compensated by changing the time t2 till the expansion velocity of the piezo-electric element 5 is abruptly decreased since the abrupt expansion thereof was started, i.e., by changing the inclination of the voltage when abruptly expanded.

Figure 4:
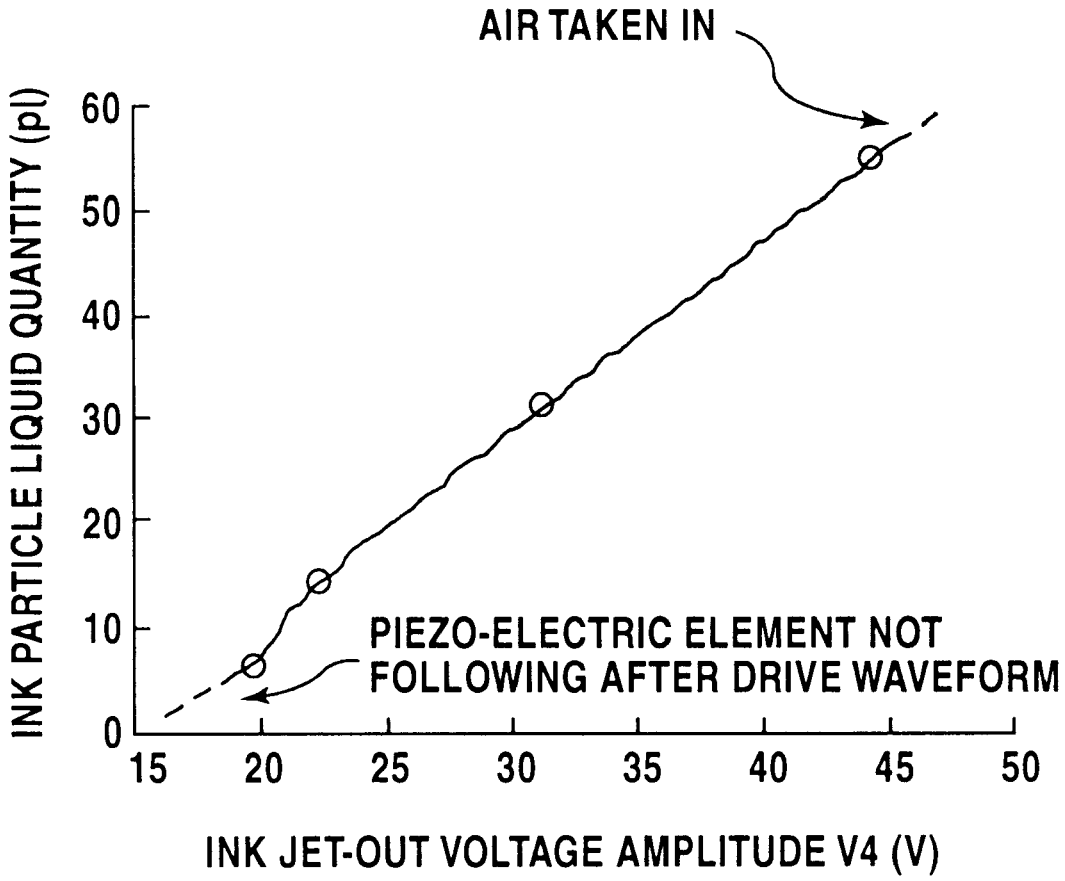
FIG. 4 is a graph showing characteristic in the first embodiment of the present invention.

FIG. 4 is a characteristic diagram in the first embodiment of the present invention.

FIG. 4 shows variations in the liquid quantity of the ink particles when changing the potential difference V4 described above. In the case of jetting out the ink particles having the normal particle size, a test uses a head, wherein an ink sucking time t1 is 80 μs, an ink jetting time t3 is 8 μs, and a voltage amplitude V5 assumes a drive waveform of 45v (indicated by the dotted line in FIG. 1). At this time, the head jets out the ink particles on the order of 55 pl. The ink particle quantity can be reduced down to 7 pl when changing the potential difference V4 by using this head.

Thus, the ink particle quantity can be varied in a wide range, and the fluctuations in the velocity can be restrained down to 10% or under.

Figure 5A:
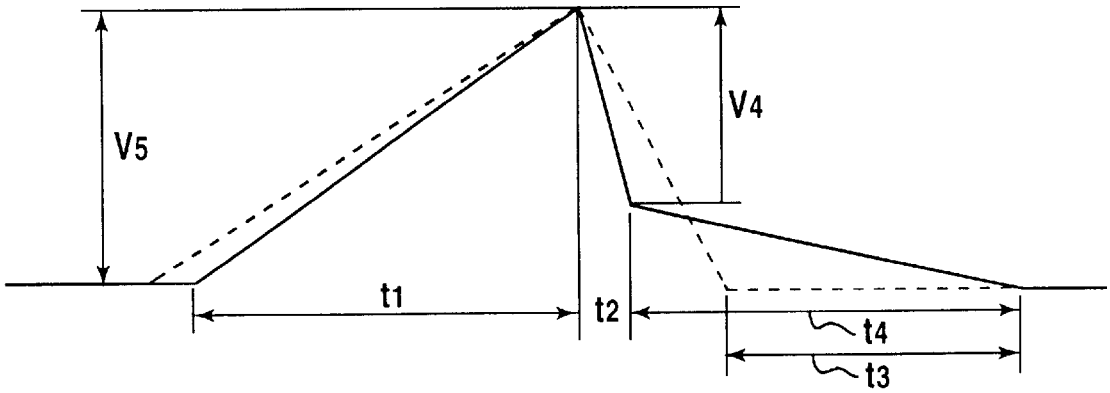
FIGS. 5A, 5B and 5C are explanatory diagrams showing a second embodiment of the present invention.
Figure 5B:
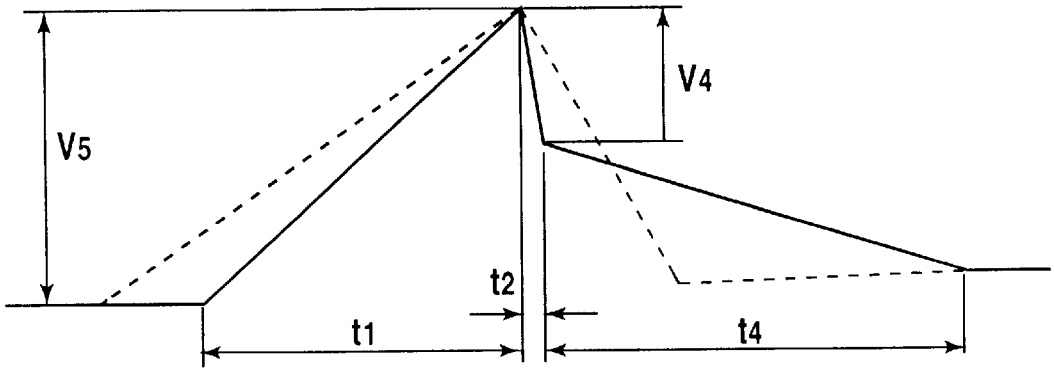
Figure 5C:
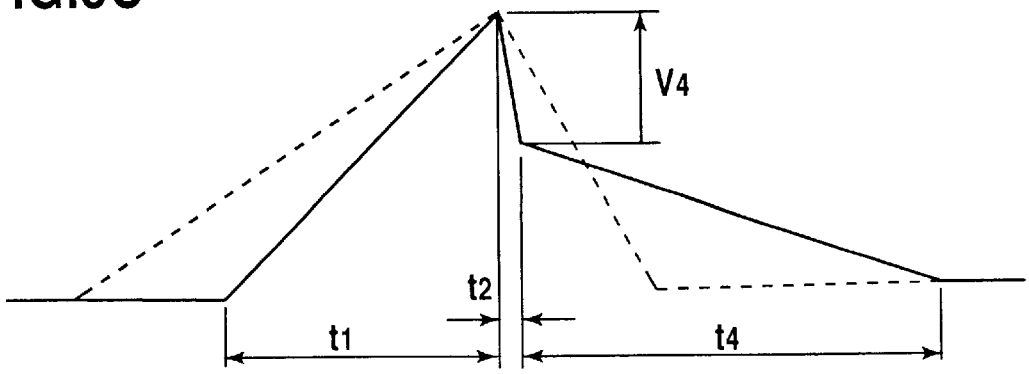

FIGS. 5A, 5B and 5C are explanatory diagrams showing a second embodiment of the present invention. FIG. 6 is a characteristic chart relative to FIGS. 5A through 5C.

As shown in FIG. 6, levels 1–4 are set corresponding to quantities of the ink particles generated. A drive waveform of the level 1 is indicated by dotted lines in FIGS. 5A to 5C. In this drive waveform, the voltage amplitude V5 is 43.5v, the ink sucking time t1 is 80 μs, the ink jetting time t2 is 6 μs, and the potential difference V4/V5 is 1.0. This is set as an ink particle quantity of the normal particle size, which quantity is on the order of 56 pl.

A drive waveform of the level 2 is indicated by a solid line in FIG. 5A. In this drive waveform, the voltage amplitude V5 is 43.5v, the ink sucking time t1 is 70 μs, the ink jetting time t2 is 3 μs, the potential difference V4/V5 is 0.7, and a restoration time t4 is 22 μs. The ink particle quantity at this time is 31 pl.

A drive waveform of the level 3 is indicated by a solid line in FIG. 5B. In this drive waveform, the voltage amplitude V5 is 43.5v, the ink sucking time t1 is 60 μs, the ink jetting time t2 is 1 μs, the potential difference V4/V5 is 0.5, and the restoration time t4 is 24 μs. The ink particle quantity at this time is 12 pl.

A drive waveform of the level 4 is indicated by a solid line in FIG. 5C. In this drive waveform, the voltage amplitude V5 is 43.5v, the ink sucking time t1 is 50 μs, the ink jetting time t2 is 1 μs, the potential difference V4/V5 is 0.46, and the restoration time t4 is 24 μs. The ink particle quantity at this time is 5 pl.

Thus, in the head having the ink particle quantity as maximum as 56 pl, the ink particle quantity can be so changed as to be minimized down to 5 pl. Further, the ink sucking time is slightly changed, thereby varying an ink sucking velocity. With this change, the ink particle quantity can be varied in much wider range. Moreover, the ink jetting velocity is compensated by changing the ink jetting time t2. The ink jetting velocity thereby becomes substantially constant.

Figure 7:
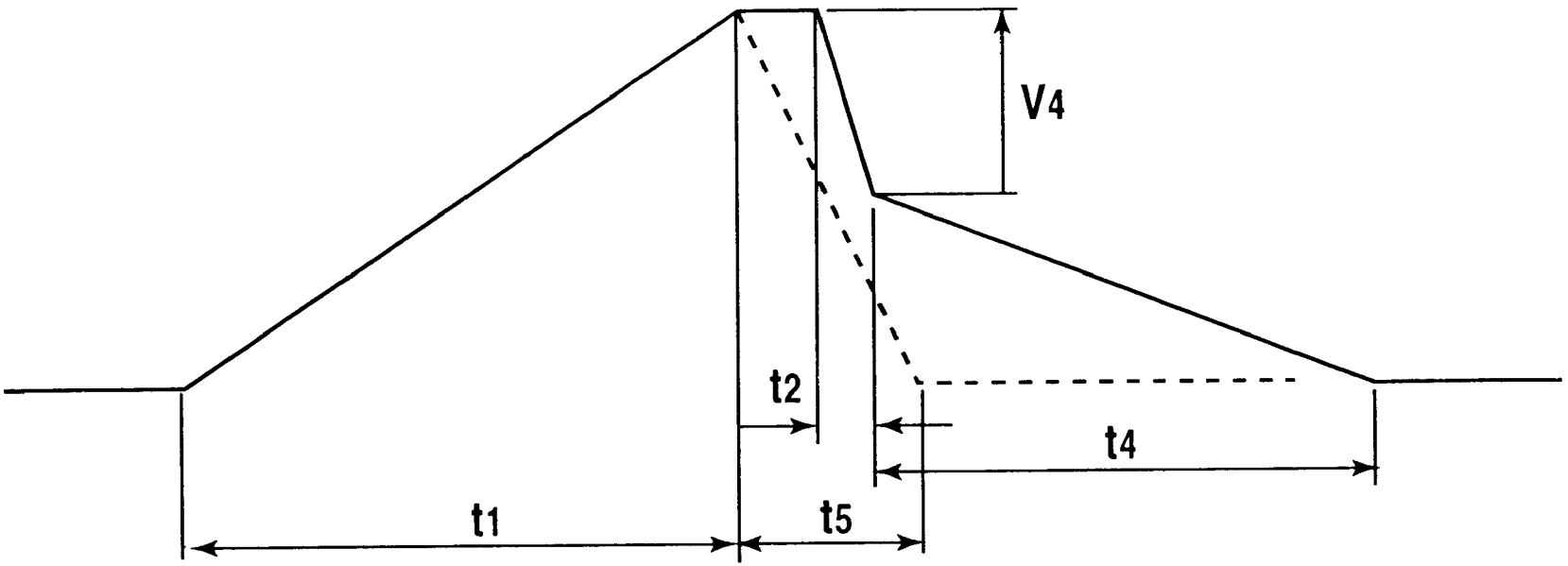
FIG. 7 is an explanatory diagram showing a third embodiment of the present invention.

FIG. 7 is an explanatory diagram showing a third embodiment of the present invention. FIGS. 8A to 8E are explanatory diagrams showing operations in the third embodiment of the present invention.

Figures 8A, 8B, 8C, 8D, 8E:
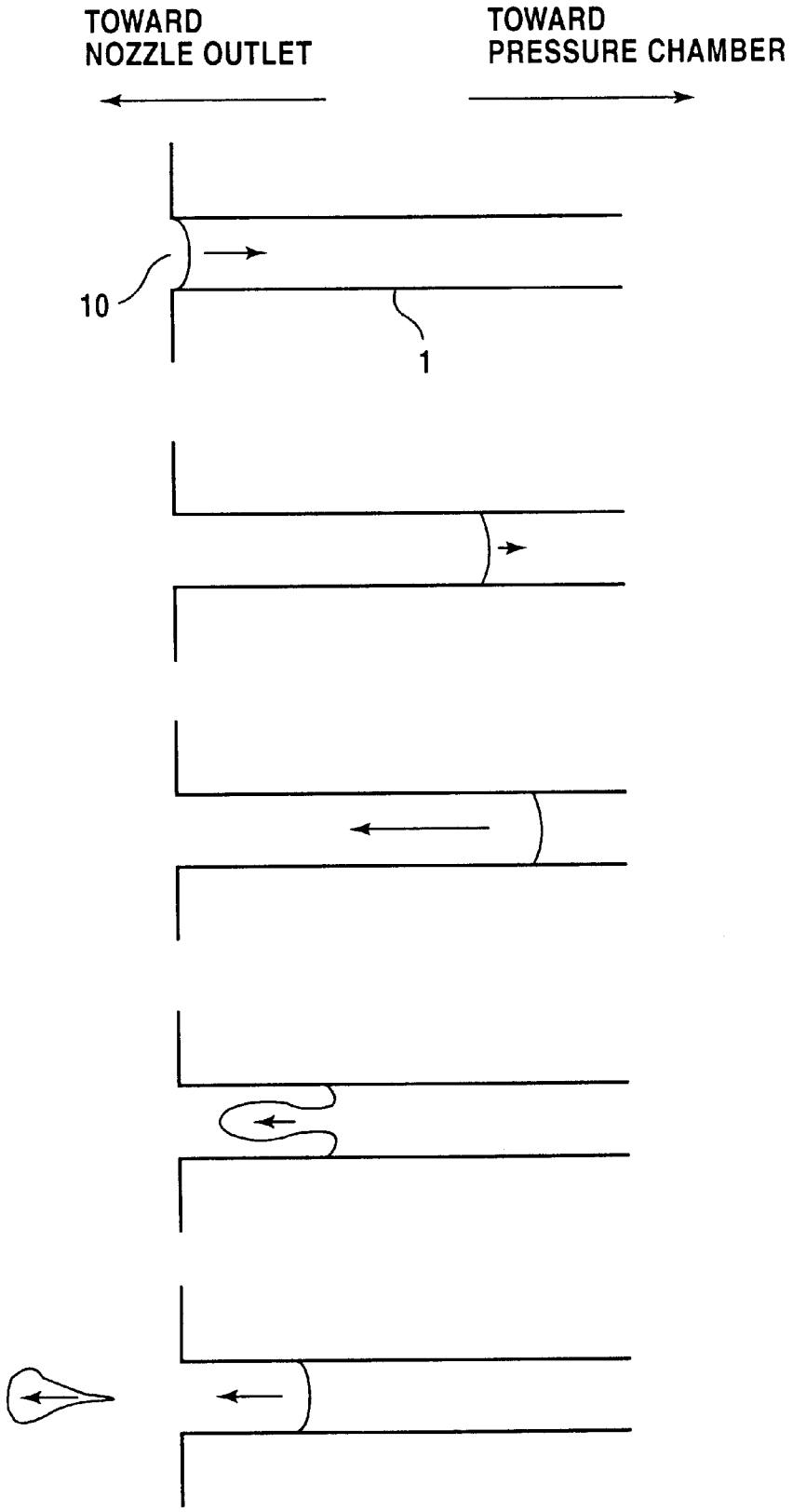
FIGS. 8A, 8B, 8C, 8D and 8E are explanatory diagrams showing an operation in the third embodiment of the present invention.

A dotted line in FIG. 7 indicates a drive waveform when jetting out the normal quantity of ink particles. A solid line in FIG. 7 indicates a drive waveform when jetting out the relatively small quantity of ink particles. FIGS. 8A and 8B are explanatory diagrams showing operations in the case of jetting out the small ink particles.

FIG. 8A shows a state of how the nozzle and the meniscus might be when the meniscus starts moving toward the pressure chamber from the initial position. At this time, as shown in FIG. 7, the first drive voltage having the inclination in the positive direction is applied to the piezo-electric element 5. With this voltage application, the piezo-electric element 5 shrinks, whereby the negative pressure is produced within the pressure chamber 6. The meniscus is thereby receded toward the pressure chamber from the initial position.

FIG. 8B shows a state of how the nozzle and the meniscus might be when the meniscus starts quickly moving toward the outlet of the nozzle 1 immediately after the piezo-electric element 5 has switched over to the expansion from the contraction. More specifically, as shown in FIG. 7, the first drive voltage having the positive inclination is applied to the piezo-electric element 5 for the time t1. Consequently, the meniscus is receded to the first predetermined position in the nozzle 1. Thereafter, a quantity of this recession is the same as that in the case of jetting out the normal quantity of ink particles.

At this time, the ink liquid still has a residual velocity to move toward the pressure chamber. If immediately shifted to the ink jetting operation, it follows that there must be a futile energy of jetting out the inks, corresponding to a speed required therefor. Then, as shown in FIG. 7, after an end of the movement toward the pressure chamber, the operation is halted for a fixed period (t5–t2) till the velocity remaining in the ink liquid disappears without shifting to the next stage.

As shown in FIG. 8C, the piezo-electric element 5 is, upon applying the second drive voltage having the negative inclination thereto, switched over to the expansion. The meniscus is thereby quickly moved toward the outlet of the nozzle 1.

When the meniscus reaches the second position within the nozzle, the expansion velocity of the piezo-electric element 5 is abruptly reduced. FIG. 8D shows a state of how the nozzle and the meniscus might be at that moment. To be more specific, as shown in FIG. 7, the second drive voltage having the negative steep inclination is applied to the piezo-electric element 5 for the time t2. A potential difference caused there is V4. Then, after the time t2 has elapsed, the voltage is changed to the third drive voltage having the negative gentle inclination. The piezo-electric element 5 is thereby abruptly decreased in terms of the expanding velocity.

In this state, the small quantity of inks existing at the edge of the meniscus within the nozzle 1 are sufficiently accelerated. Then, the ink liquid posterior thereto within the nozzle 1 comes to a state of being abruptly decelerated. Therefore, the ink liquid in the vicinity of the meniscus starts getting particled.

FIG. 8E shows a state of how the nozzle and the meniscus might be when the piezo-electric element 5 stops its expansion. More specifically, it is a state after the third drive voltage has been applied for the time t4. In this state, the small quantity of ink liquid accelerated enough steers clear of the surface tension and gets particled. Further, the inks inside the nozzle 1 are temporarily forced to move inwardly of the nozzle by the negative pressure in the pressure chamber 6 that is produced due to the ink flux to the ink supply port and the nozzle 1. Thereafter, the inks return to the vicinity of the nozzle outlet due to the surface tension.

In the third embodiment also, when changing the particle quantity of the ink particles, a change in the quantity of recession of the inks is not permitted, and therefore the ink liquid can be sufficiently accelerated, within the nozzle. Then, the moving quantity from the first position to the second position is changed by changing the potential difference V4 till the expansion velocity of the piezo-electric element 5 is abruptly decreased since the abrupt expansion thereof was started. The ink particles, the quantity of which corresponds to the shift quantity, can be thereby generated.

Then, the velocity can be also compensated by changing the time t2 till the expansion velocity of the piezo-electric element 5 is abruptly decreased since the abrupt expansion thereof was started, i.e., by changing the inclination of the voltage when abruptly expanded.

Further, the period during which to absorb the velocity of the ink liquid is provided before the ink jetting operation, and hence the ink jetting energy can be used at a high efficiency.

Figure 9:
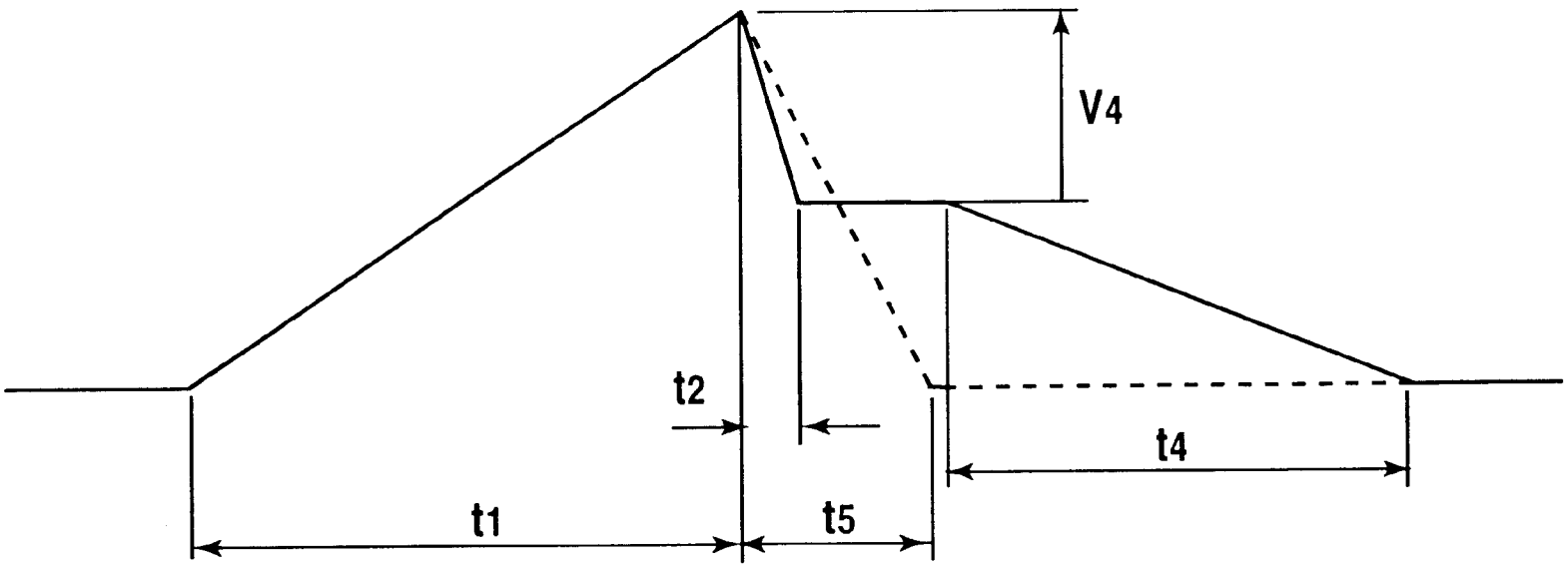
FIG. 9 is an explanatory diagram showing a fourth embodiment of the present invention.

FIG. 9 is an explanatory diagram showing a fourth embodiment of the present invention. FIGS. 10A through 10E are explanatory diagrams showing operations in the fourth embodiment of the present invention.

A dotted line in FIG. 9 indicates a drive waveform when jetting out the normal quantity of ink particles. A solid line in FIG. 9 indicates a drive waveform when jetting out the relatively small quantity of ink particles.

FIGS. 10A through 10E are explanatory diagrams showing operations in the case of jetting out the ink particles of the small particle size.

Figure 10A:
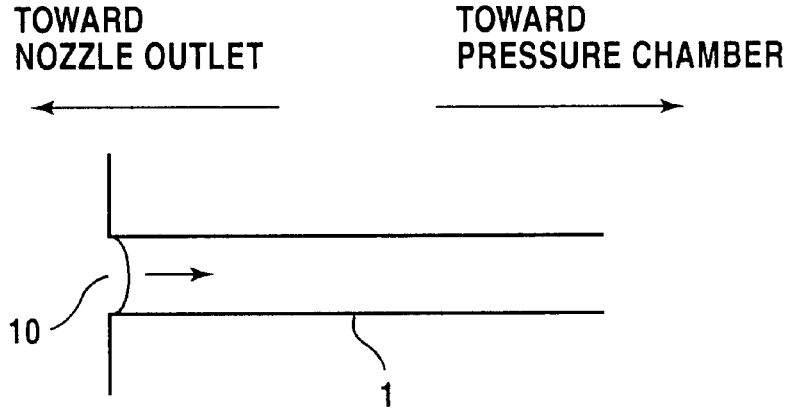
FIGS. 10A, 10B, 10C, 10D and 10E are explanatory diagrams showing an operation in the fourth embodiment of the present invention.

FIG. 10A shows a state of how the nozzle and the meniscus might be when the meniscus starts moving toward the pressure chamber from the initial position; At this time, as shown in FIG. 9, the first drive voltage having the inclination in the positive direction is applied to the piezo-electric element 5. With this voltage application, the piezo-electric element 5 shrinks, whereby the negative pressure is produced within the pressure chamber 6. The meniscus is thereby receded toward the pressure chamber from the initial position.

Figure 10B:
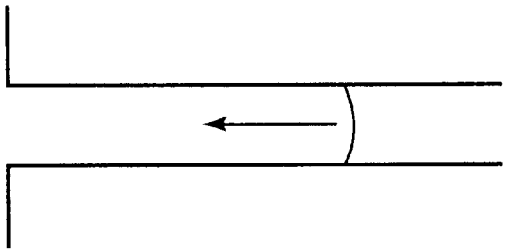

FIG. 10B shows a state of how the nozzle and the meniscus might be when the meniscus starts quickly moving toward the outlet of the nozzle 1 immediately after the piezo-electric element 5 has switched over to the expansion from the contraction. More specifically, as shown in FIG. 9, the first drive voltage having the positive inclination is applied to the piezo-electric element 5 for the time t1. Consequently, the meniscus is receded to the first predetermined position in the nozzle 1. Thereafter, the quantity of this recession is the same as that in the case of jetting out the normal quantity of ink particles.

Then, the piezo-electric element 5 is, upon applying the second drive voltage having the negative inclination thereto, switched over to the expansion. The meniscus is thereby quickly moved toward the outlet of the nozzle 1.

Figure 10C:
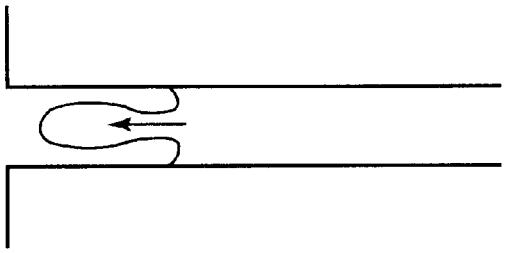

When the meniscus reaches the second position within the nozzle, the expansion velocity of the piezo-electric element 5 is abruptly reduced. FIG. 10C shows a state of how the nozzle and the meniscus might be at that moment. To be more specific, as shown in FIG. 9, the second drive voltage having the negative steep inclination is applied to the piezo-electric element 5 for the time t2. A potential difference caused there is V4.

In this state, the small quantity of inks existing at the edge of the meniscus within the nozzle 1 are sufficiently accelerated. Then, the ink liquid posterior thereto within the nozzle 1 comes to a state of being abruptly decelerated. Therefore, the ink liquid in the vicinity of the meniscus starts getting particled.

Figure 10D:
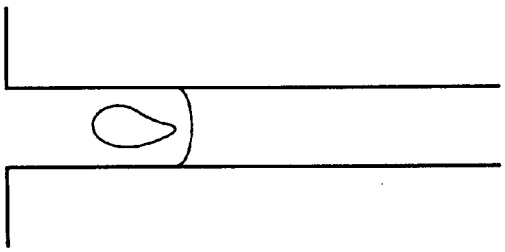

When the ink liquid starts getting particled, the meniscus is stopped. FIG. 10D shows a state of how the nozzle and the meniscus might be at that time. Thus, it is feasible to prevent the ink liquid exhibiting a sufficient kinetic energy from being mixed with the ink liquid having an insufficient kinetic energy by temporarily stopping the meniscus. Owing to this prevention, it is possible to prevent the velocity of the ink particles from decreasing and the ink particle quantity from increasing as well.

Then, after a time t5 has passed, the voltage is changed to the third drive voltage having the negative gentle inclination. The piezo-electric element 5 is thereby delayed in terms of the expanding velocity.

Figure 10E:
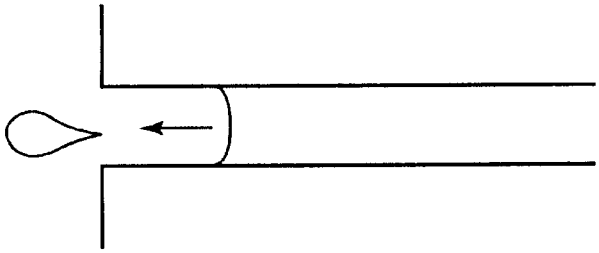

FIG. 10E shows a state of how the nozzle and the meniscus might be when the meniscus is returned to the initial position at a low velocity. In this state, the small quantity of sufficiently accelerated ink liquid steers clear of the surface tension and gets particled. Further, the inks inside the nozzle 1 are temporarily forced to move inside the nozzle by the negative pressure in the pressure chamber 6 that is produced due to the ink flux to the ink supply port and the nozzle 1. Thereafter, the inks return to the vicinity of the nozzle outlet due to the surface tension.

In the fourth embodiment also, when changing the particle quantity of the ink particles, the change in the quantity of recession of the inks is not permitted, and therefore the ink liquid can be sufficiently accelerated within the nozzle. Then, the shift quantity from the first position to the second position is changed by changing the potential difference V4 till the expansion velocity of the piezo-electric element 5 is abruptly decreased since the abrupt expansion thereof was started. The ink particles, the quantity of which corresponds to the shift quantity, can be thereby generated.

Then, the velocity can be also compensated by changing the time t2 till the expansion velocity of the piezo-electric element 5 is abruptly decreased since the abrupt expansion thereof was started, i.e., by changing the inclination of the voltage when abruptly expanded.

Further, the meniscus is temporarily stopped during the ink jetting operation, and it is therefore feasible to prevent the ink liquid exhibiting the sufficient kinetic energy from being mixed with the ink liquid having the insufficient kinetic energy. Owing to this prevention, it is possible to prevent the velocity of the ink particles from decreasing and the ink particle quantity from increasing as well. Accordingly, a smaller, quantity of ink particles can be generated, and the ink particle quantity can be controlled in a broader range.

Figure 11:
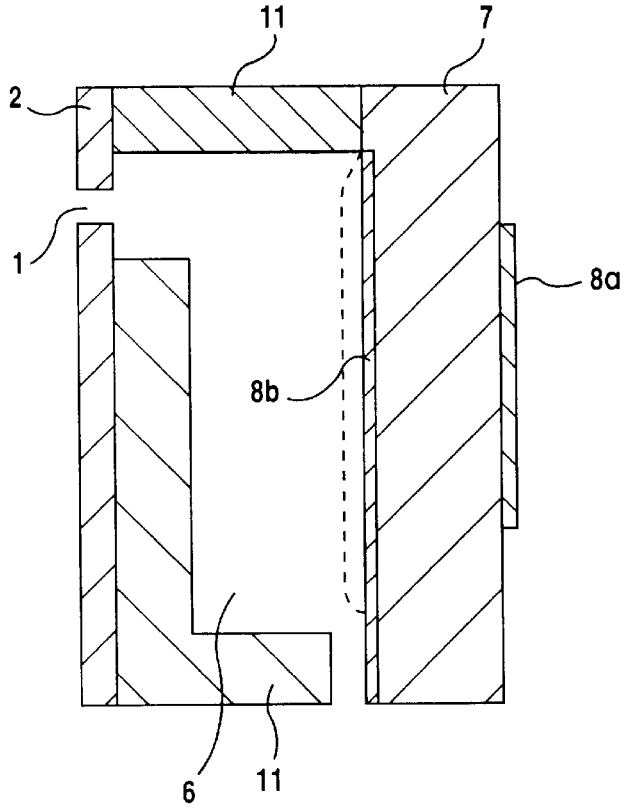
FIG. 11 is diagram illustrating another construction of the ink jet head used for the present invention.
Figure 12:
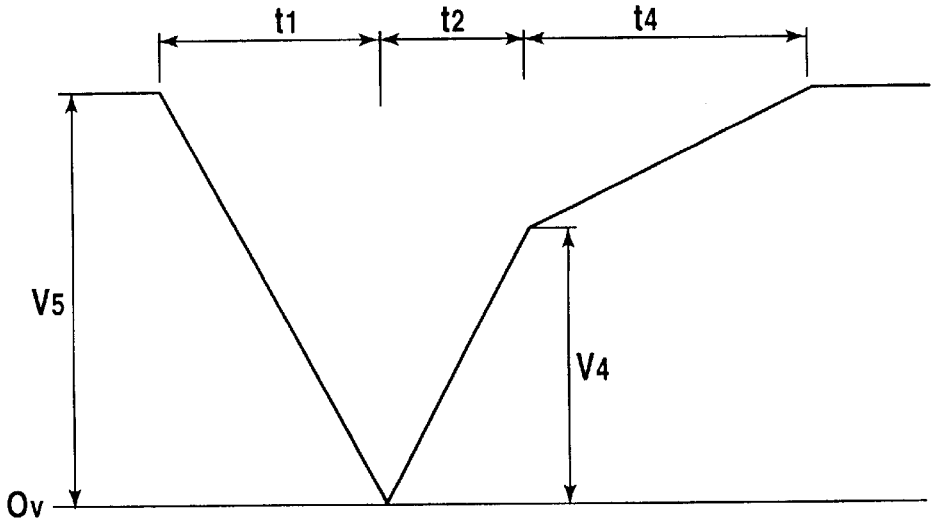
FIG. 12 is an explanatory diagram showing a fifth embodiment of the present invention.

FIG. 11 is a view showing another construction of the ink jet head. FIG. 12 is an explanatory diagram showing the fourth embodiment of the present invention.

As shown in FIG. 11, the nozzle plate 2 forms the nozzle 1. A wall member 11 constitutes walls by which the pressure chamber 6 is defined. A piezo-electric element 7 constitutes walls of the pressure chamber 6. This piezo-electric element 7 is provided with electrodes 8*a*, 8*b* on both surfaces.

This piezo-electric element 7 is used in such a d33-mode that the piezo-electric element 7 is expanded upon the application of the voltage. The head can be remarkably reduced in its manufacturing costs because of the piezo-electric element 7 constituting a part of the wall member of the pressure chamber 6.

FIG. 12 shows a drive waveform when the first embodiment illustrated in FIG. 1 is applied to the head in this d33-mode. That is, the voltage V5 is applied in the initial state. With this application, as indicated by a dotted line in FIG. 11, the piezo-electric element 7 expands, and the pressure chamber 6 remains shrunk.

When jetting out the inks, the drive voltage is decreased with an inclination in a 0v-direction. The piezo-electric element 7 is thereby contracted enough to cause a negative pressure within the pressure chamber 6. Therefore, the inks are sucked in the nozzle 1. When the drive voltage becomes 0v, the piezo-electric element 7 is expanded. Consequently, the drive voltage is raised with a steep inclination toward the positive voltage V4.

The drive voltage, when coming to V4, rises with a gentle inclination toward V5.

In this embodiment also, as in the first embodiment, the operations shown in FIGS. 3A to 3D are executed. This embodiment also exhibits the same operating effects as those in the first embodiment. Further, the third and fourth embodiment are applicable thereto.

Figure 13:
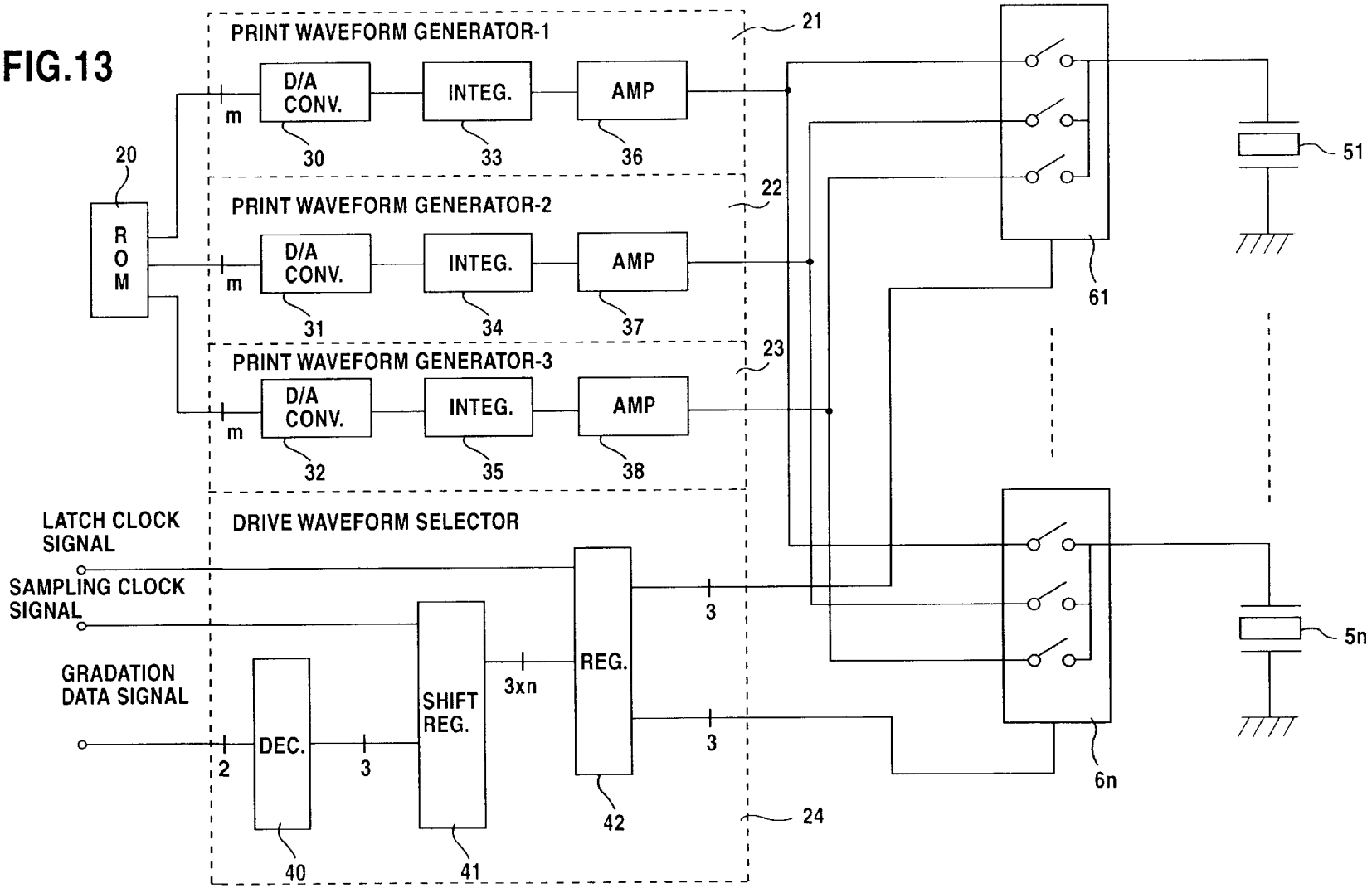
FIG. 13 is an explanatory circuit diagram showing a drive circuit according to the present invention.
Figure 14:
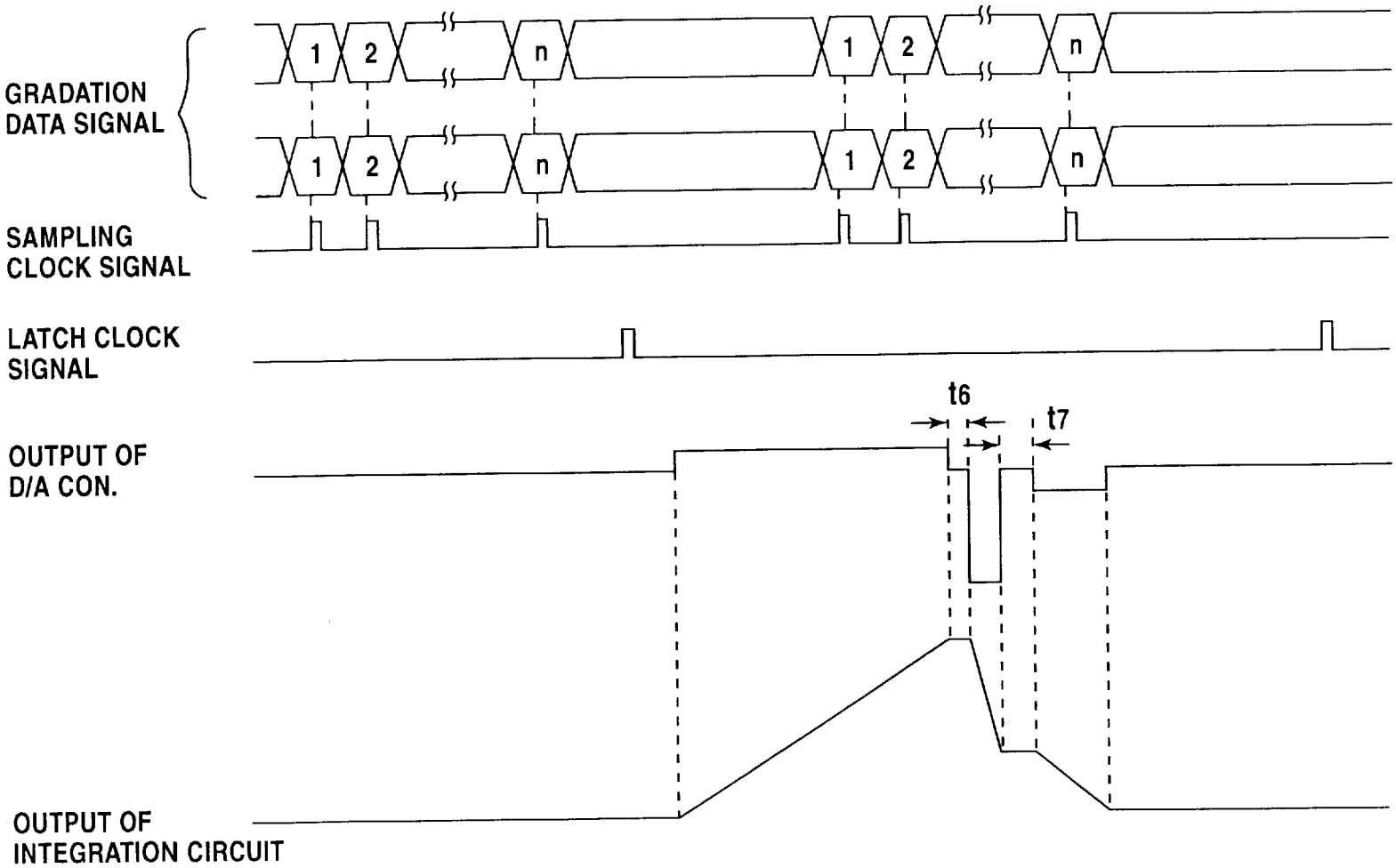
FIG. 14 is a time chart of the drive circuit shown in FIG. 13.

FIG. 13 is a diagram showing one example of a drive circuit according to the present invention. FIG. 14 is a time chart thereof. In accordance with this embodiment, dotwise gradations are expressed by changing the applied voltage per nozzle.

Referring to FIG. 13, a ROM 20 stores data for generating gradation drive waveform. Digital/analog (D/A) converters 30–32 convert drive data given from the ROM 20 into an analog quantity. Integrating circuits 33–35 integrate outputs of the D/A converters 30–32. Amplifier circuits 36–38 amplify outputs of the integrating circuits 33–35.

Print waveform generating units 21–23 generate drive waveforms different from each other, and are constructed of D/A converters 30 32, the integrating circuits 33–35 and the amplifier circuits 36–38.

Piezo-electric elements 51–5*n* are provided corresponding respective nozzles and drive the pressure chamber. Switching circuits 61–6*n* provided corresponding to the piezo-electric elements 51–5*n*, select the drive waveforms given from the print waveform generating units 21–23 in accordance with selection signals from a drive waveform selecting unit 24, and apply them to the piezo-electric elements 51–5*n*.

The drive waveform selecting unit 24 comprises a decoder 40, a shift register 41 and a register 42. The decoder 40 converts a 2-bit gradation data signal indicating a value of gradation of each dot from an unillustrated print control unit, into a parallel 3-bit decode signal. The shift register 41 consists of a 3n-bit shift register and takes in the decode signal in response to sampling clock signal generated dotwise. The register 42 is constructed of a 3n-bit register and latches a content of the shift register 41 in response to a latch clock signal generated for every n-dots.

An operation thereof will be explained. Under the control of the unillustrated print control unit, the ROM 20 outputs three kinds of m-bit drive waveform-generating data to three print waveform generating units 21–23. The D/A converters 30–32 in the print waveform generating units 21–23 generate voltages corresponding to data signals thereof. Then, the integrating circuits 33–35 integrate the thus generated voltages and output the drive waveforms. The drive waveforms may be determined by a time and voltage levels of the D/A converters 30–32, and integration constants of the integrating circuits 33–35. Outputs of the integrating circuits 33–35 are amplified by the amplifier circuits 36–38 and outputted to the switching circuits 61–6*n*.

On the other hand, the 2-bit gradation data signals indicating the values of the gradations of the respective dots to be jetted, are inputted to the decoder 40 and converted into 3-bit decode signals. Respective bits of these signals correspond to switches in the switching circuits 61–6*n*. Then, the 3-bit decode signals are outputted corresponding to the gradation data signals in such a state that 1 bit of the 3 bits is invariably ON, or all the bits are OFF.

Those 3-bit decode signals are sequentially taken into the shift register 41 in response to the sampling clock signals. When the signals of all the piezo-electric elements 51–5*n* are taken into the shift register 41, a content of the shift register 41 is held by the register 42 in response to a latch clock signal. Then, the shift register 41 comes to a status of waiting for inputting a next print signal.

The signals held by the register 42 are outputted to the switching circuits 61–6*n* connected to the piezo-electric elements 51–5*n*. In the switching circuits 61–6*n*, one of the three switches is turned ON, or alternatively all the switches are brought into an OFF-state in response those signals.

Owing to this operation, the piezo-electric elements 51–5*n* are in such a state that a drive waveform for no printing is not applied, or that one of the drive waveforms for jetting a high density dot, a normal density dot and a low density dot from the print waveform generating unit 21–23, is applied.

A further explanation is given referring to FIG. 14. The gradation data signals are defined as 2-bit signals and have values of "0"–"3". Then, all the piezo-electric elements 51–5*n* are supplied with each of these signals. These signals indicate densities of the inks jetted by the piezo-electric elements 51–5*n* when jetting out the inks next time. For example, if the gradation data signal is the 2-bit signal, this indicates four categories such as "no printing", "high density", "normal density" and "low density".

The decoder 40 converts the gradation data signal into a 3-bit decode signal. The converted gradation data signal is taken into the shift register 41 in response to the sampling clock signal. After all the gradation data signals have been taken into the shift register 41, a content of the shift register 41 is copied on the register 42 in response to a latch signal. The signal of the register 42 selects the switch of the switching circuits 61–6*n*.

The ROM 20 outputs the drive data relative to "high density", "normal density" and "low density" to the print waveform generating units 21–23. Signals for changing the waveform voltages, which are being outputted at present, are outputted from outputs of the D/A converters 30–32. A velocity of these changes may be determined by values of the voltages outputted by the D/A converters 30–32. Further, a time for increasing the output voltage may be determined by a signal output time width of the D/A converters 30–32.

FIG. 14 shows a drive waveform as a combination of the drive waveforms in the second and third embodiments discussed above. When a time t6 is set to "0", however, it shows the drive waveform in the third embodiment. When a time t7 is set to "0", it shows the drive waveform in the second embodiment. If the time t6 and the time t7 are set to "0", it shows the drive waveform in the first embodiment.

Thus, the print waveform generating units 21–23 generate the drive waveforms in three kinds of gradations. Along with this, the switching circuits 61–6*n* connected to the piezo-electric elements 51–5*n* are selected corresponding to the gradation data signals. The drive waveforms designated by the gradation data signals are thereby applied to the piezo-electric elements 51–5*n*. Therefore, the ink particles having ink quantities corresponding to the gradations are jetted out of the nozzles driven by the piezo-electric elements 51–5*n*.

Figure 15:
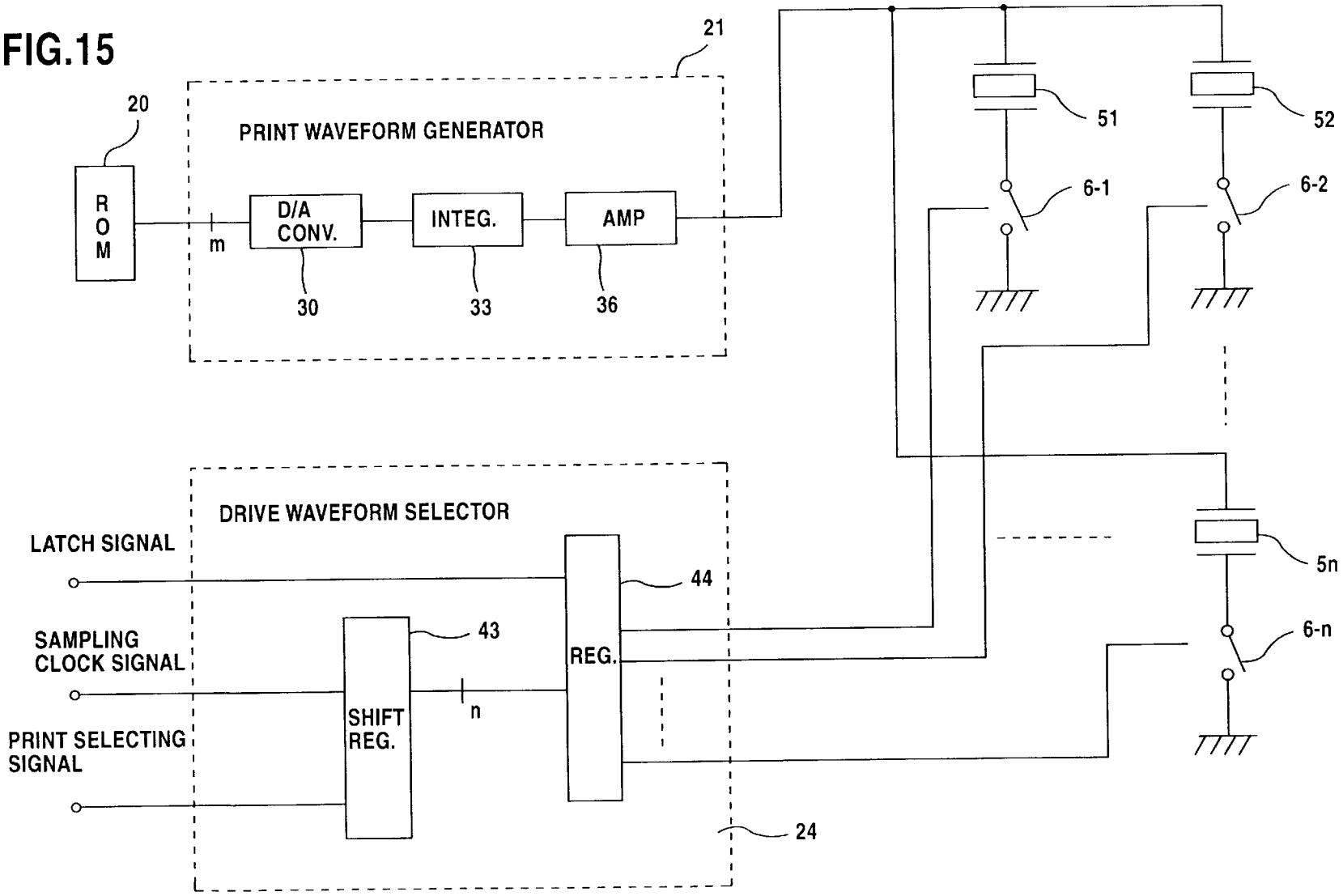
FIG. 15 is an explanatory circuit diagram showing another drive circuit according to the present invention.

FIG. 15 is a circuit diagram illustrating another drive circuit for the embodiment of the present invention. Referring to FIG. 15, the same components as those shown in FIG. 13 are marked with the like numerals. In this embodiment, the single print waveform generating unit 21 generates the drive waveform for jetting out the ink particles with a certain gradation. The print waveform generating unit 21 changes the drive waveform a gradation-number of times and outputs them, thus performing the dotwise gradations.

Switches 6-1 to 6-n are provided corresponding to the piezo-electric elements 51–5*n*, and determine whether or not the drive waveforms are applied to the piezo-electric elements 51–5*n*. Under the control of the unillustrated print control unit, the ROM 20 sequentially outputs three kinds of m-bit drive waveform generation data to the single print waveform generating unit 21. In the print waveform generating unit 21, the D/A converter 30 generates a voltage corresponding to this data signal. Then, the integrating circuit 33 integrates the voltage generated and output a drive waveform. The drive waveform may be determined by a time and a voltage level of the D/A converter 30, and an integration constant of the integrating circuit 33. The output of the integrating circuit 33 is amplified by the amplifier circuit 36 and outputted to each of the piezo-electric elements 51–5*n*.

On the other hand, a 1-bit print selection signal indicating an ON/OFF state of each nozzle to jet the inks is sequentially taken into the shift register 41 in response to the sampling clock signal. When the signals of all the piezo-electric elements 51–5*n* are taken into the shift register 41, a content of the shift register 41 is held by the register 42 in response to the latch clock signal. Then, the shift register 41 comes to a status of waiting for inputting the next print signal.

The signals held by the register 42 are outputted to the switches 6-1 through 6-n connected to the piezo-electric elements 51–5*n*. The switches 6-1 to 6-n are controlled ON or OFF by these signals.

Owing to this operation, the piezo-electric elements 51–5*n* are in such a state that the drive waveform for no printing is not applied, or that the drive waveform from the print waveform generating unit 21 is applied. This drive waveform sequentially changes to drive waveforms for jetting the high density dot, the normal density dot and the low density dot.

The ROM 20 sequentially outputs the drive data relative to "high density", "normal density" and "low density" to the print waveform generating unit 21, and hence the drive waveform changes corresponding to the gradations. In the drive waveform for each gradation, the print selection signal is set ON/OFF, whereby drive signal for a designated gradation are applied to the designated piezo electric elements 51–5*n*. The ink particles for expressing the designated gradation can be thereby jetted out of the nozzles drive by the piezo-electric elements 51–5*n*.

Next, a relationship between an ambient temperature and an ink jetting quantity will be explained.

Figure 16:
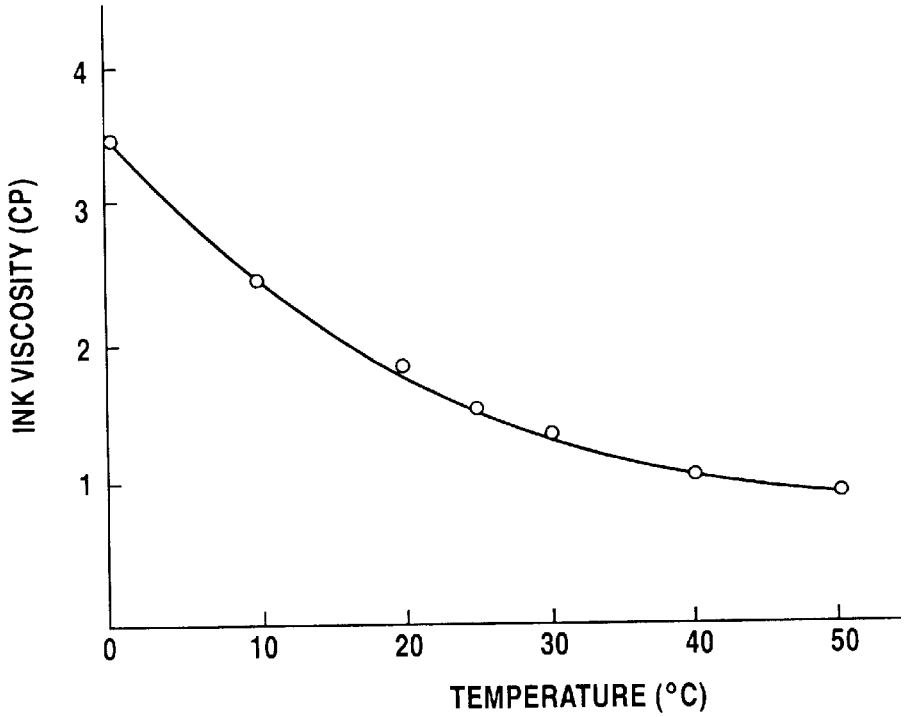
FIG. 16 is an explanatory graph showing a relationship between a temperature and an ink viscosity according to the present invention.
Figure 17:
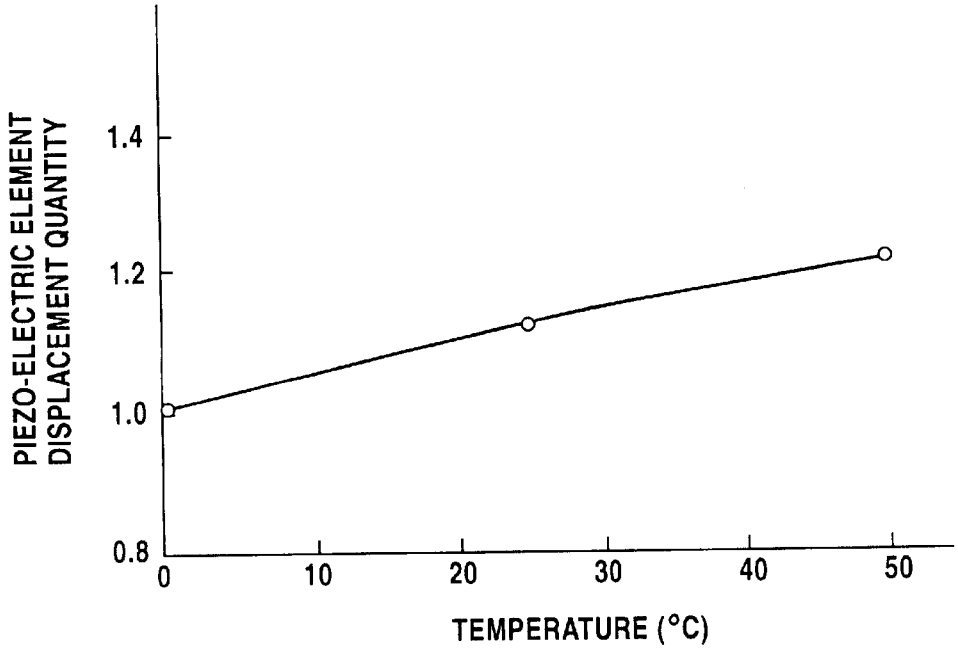
FIG. 17 is an explanatory graph showing a relationship between the temperature and a piezo-electric displacement quantity according to the present invention.
Figure 18:
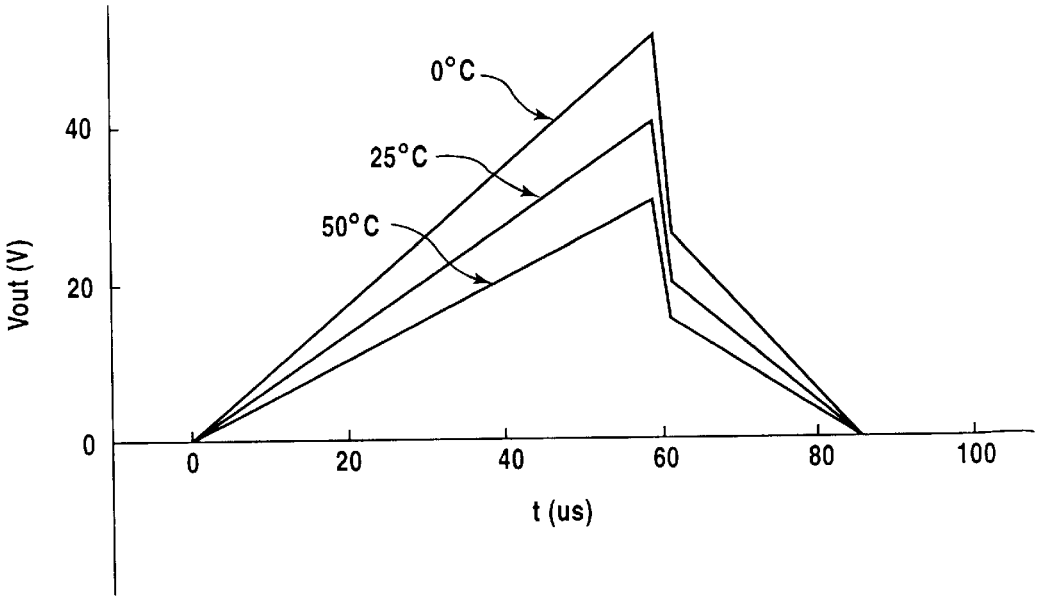
FIG. 18 is an explanatory graph showing waveforms when compensating the temperature according to the present invention.
Figure 19:
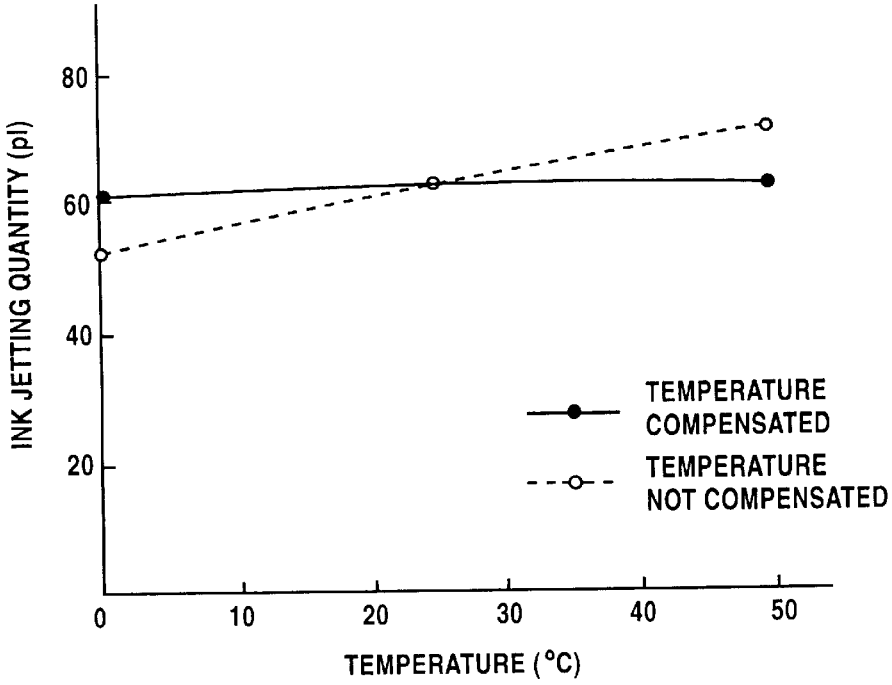
FIG. 19 is an explanatory graph showing a relationship between the temperature and an ink jetting quantity according to the present invention.
Figure 20:
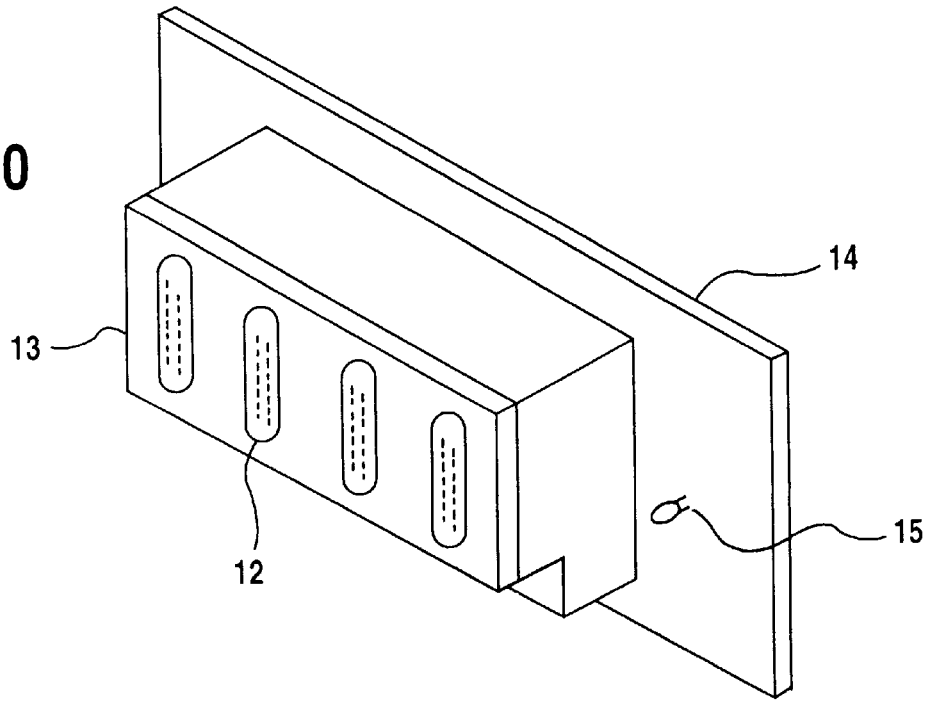
FIG. 20 is an explanatory view illustrating a construction of the head according to the present invention.
Figure 21:
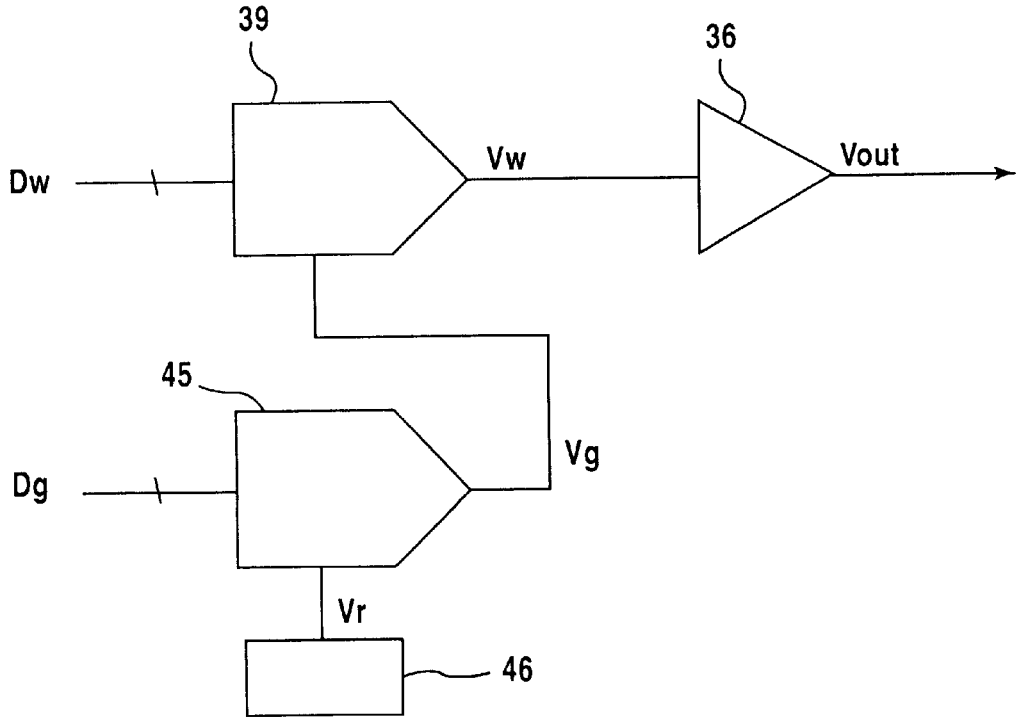
FIG. 21 is an explanatory diagram showing a construction of a head drive circuit according to the present invention.

FIG. 16 is a graph showing a relationship between a temperature and an ink viscosity. FIG. 17 is a graph showing a relationship between a temperature and a piezo-electric element displacement quantity. FIG. 18 is a graph showing a drive waveform when compensating the temperature. FIG. 19 is a graph showing a relationship between the temperature and the ink jetting quantity. FIG. 20 is a graph showing a construction of the head according to the present invention. FIG. 21 is a graph showing a construction of a head drive circuit according to the present invention.

As shown in FIG. 16, as seen in the relationship between the temperature and the ink viscosity, the ink viscosity becomes lower as the temperature gets higher. Further, as shown in FIG. 17, according to the relationship between the temperature and the piezo-electric element displacement quantity, the displacement quantity of the piezo-electric element becomes greater as the temperature rises.

Hence, as indicated by a dotted line in FIG. 19, the ink jetting quantity becomes larger at higher temperatures. Namely, the displacement quantity of the piezo-electric element is small at a low temperature, and the ink viscosity increases, resulting in a decrease in the ink jetting quantity. Therefore, a print density is lowered. Reversely, the displacement quantity of the piezo-electric element augments at a high temperature, and the ink viscosity decreases, resulting in increase in the ink jetting quantity. Therefore, the print density increases.

Prevention of the variations in the ink jetting quantity with respect to the temperature may involve changing the drive signal corresponding to the temperature. This might need to prepare various items of drive data corresponding to the temperatures. The preparation for the various items of drive data corresponding to the temperatures may be time-consuming, and, besides, the ROM 20 is required to have a storage space.

For preventing this, in accordance with this embodiment, as shown in FIG. 18, the amplitude of the drive signal is varied without changing the drive data (drive patterns). More specifically, as shown in FIG. 18, the amplitude of the drive signal is increased when at a low temperature but decreased when at a high temperature.

With this setting, as indicated by a solid line in FIG. 19, the ink jetting quantity can be uniformalized irrespective of the head temperatures.

FIGS. 20 and 21 show a method of actualizing this without changing the drive data. As illustrated in FIG. 20, an ink jet head 13 is provided with four nozzle units 12 arranged in side-by-side relationship. A printed board 14 of this head 13 is provided with a temperature detecting device 15. The temperature detecting device 15 constructed of a thermistor is provided in the vicinity of the head 13 and works to detect a temperature of the head 13.

As shown in FIG. 21, the head drive circuit is constructed of a reference voltage generating circuit 46, an amplitude voltage generating circuit 45, a drive waveform generating circuit 39 and an amplifier circuit 36. The reference voltage generating circuit 46 generates a reference voltage Vr for the amplitude voltage generating circuit 45.

The amplitude voltage generating circuit 45 is constructed of a multiplication type digital/analog (D/A) converter. The amplitude voltage generating circuit 45 to which amplitude data Dg indicating an amplitude voltage is inputted, generates an amplitude voltage Vg having a magnitude corresponding to the amplitude data Dg.

The amplitude data Dg is given from the unillustrated print control circuit. The print control circuit determines the amplitude data Dg from a detection output of the temperature detecting device 15, and output it to the amplitude voltage generating circuit 45. The print control circuit, as shown in FIG. 18, determines the amplitude data Dg in accordance with a temperature detected by the temperature detecting device 15. For instance, when at the low temperature, the amplitude is increased but deceased when at the high temperature.

The drive waveform generating circuit 39 is, as illustrated in FIG. 13, constructed of a multiplication type Digital/Analog (D/A) converter and an integrating circuit. Then, the multiplication type D/A converter executes a D/A conversion of drive data (waveform data) Dw, wherein the amplitude voltage of the amplitude voltage generating circuit 45 serves as a reference voltage. The drive data Dw is, as shown in FIG. 13, outputted from the ROM 20.

An output of this multiplication type D/A converter is integrated by the integrating circuit, thereby generating a drive signal Vw. Then, the drive signal Vw is amplified by the amplifier circuit 36, and an output signal Vout is outputted to the piezo-electric element.

Thus, the drive data (the waveform data) is not changed, whereas only the amplitude of the drive signal is varied. Therefore, the various items of drive data corresponding to the temperatures are not required. Accordingly, neither the various items of drive data corresponding to the temperatures may be prepared, nor the capacity of the ROM 20 is increased.

If a correction of the ink jetting quantity according to the temperature is executed during printing of a page, it follows that a print density might change halfway the page. For this reason, it is required that an interpage correction be executed.

Given next is an explanation of how the ink jetting quantity is controlled corresponding to sheets.

An affinity between a print medium and the ink may be a compatibility of both of the ink and the print medium. Therefore, an ink impregnation quantity might change depending on the kinds of the inks and the print mediums. Hitherto, the inks and the print mediums used by the apparatus were limited to avoid changes in the ink impregnation quantity.

There is still, however, a demand for using a variety of print mediums. Hitherto, a decline in the print quantity could not be avoided in print mediums other than the limited ones. Especially when printed on the reproduced paper, blurs are easy to appear along fibers of the paper. Further, when printed on the coat paper, the blurs are also easy to appear depending on the compatibility with the ink.

Such being the case, an optimal print state is obtained by changing the ink jetting quantity corresponding to the sheet to be used.

Figure 22:
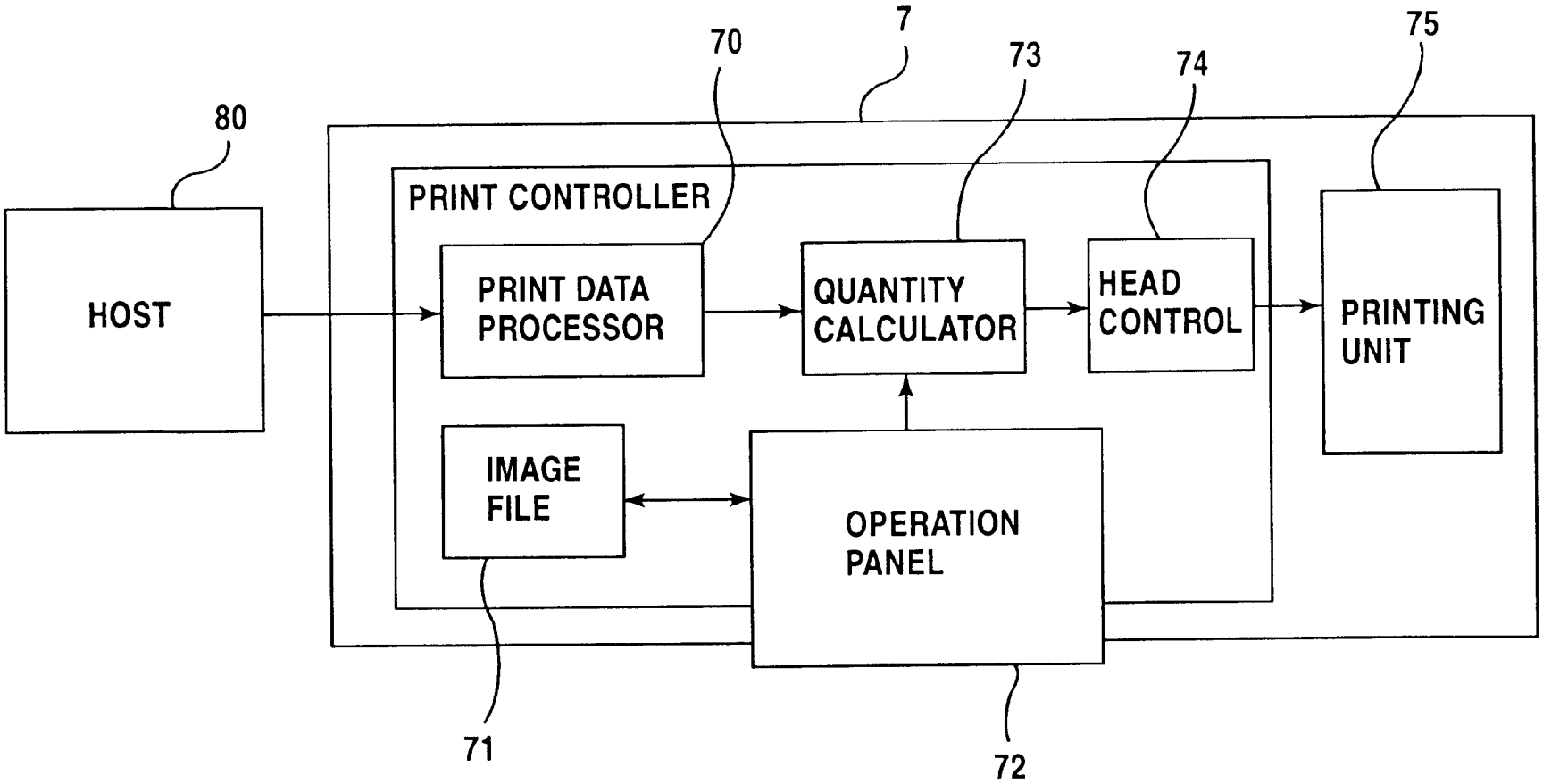
FIG. 22 is an explanatory diagram showing a construction of a print system according to the present invention.
Figure 23A:
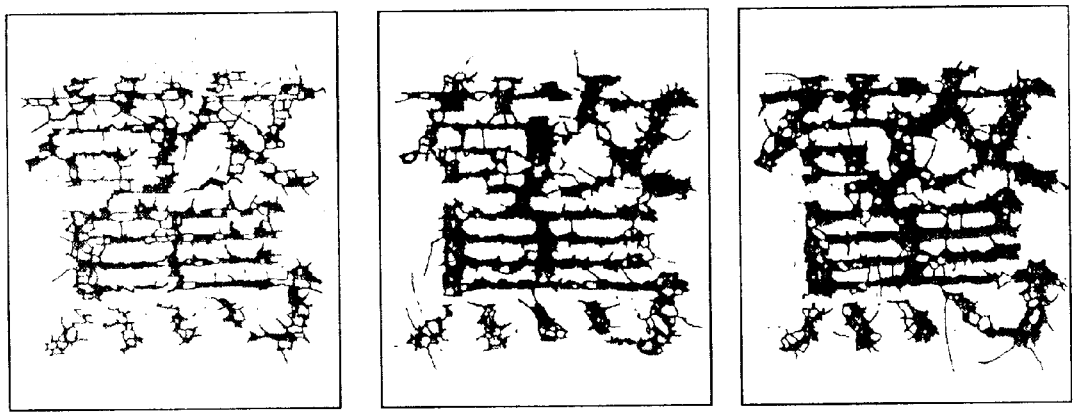
FIGS. 23A and 23B are explanatory diagrams showing a relationship between a sheet and a printed result according to the present invention.
Figure 23B:
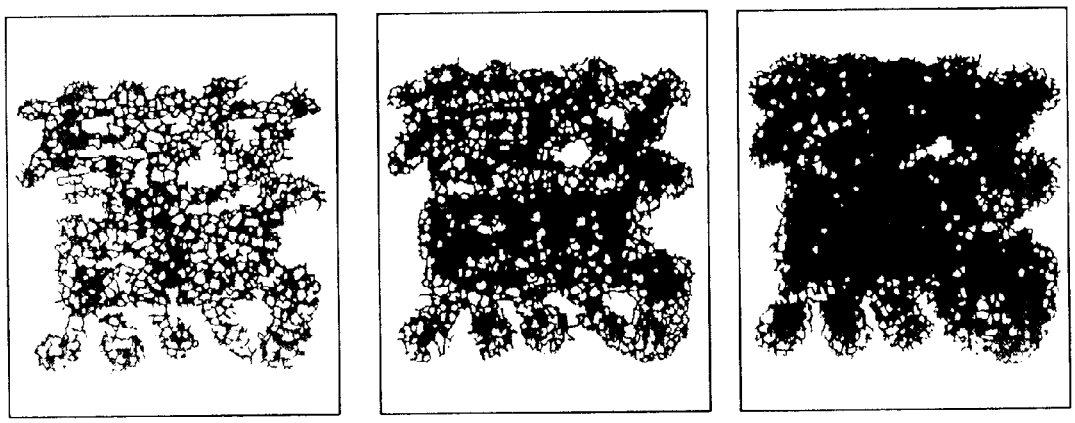

FIG. 22 is a block diagram illustrating a construction of a print system according to the present invention. FIGS. 23A and 23B are diagrams each showing a relationship between the sheet and a printed result.

A printer apparatus 7 is provided with an image file 71 constructed of a ROM or a hard disk. The image file 71 is stored with print samples when printed on a typical record sheet. As illustrated in FIG. 23A, there is prepared a print sample in which a kanji-character "odoroku" (which literally means "surprise") is printed on the reproduced paper in the case of setting the ink quantity to "large", "intermediate" and "small". As illustrated in FIG. 23B, there is prepared a print sample in which the kanji-character "odoroku" is printed on the coat paper in the case of setting the ink quantity to "large", "intermediate" and "small". Then, these print samples are stored in the image file 71.

An operation panel 72 comprises a switch for selecting types of the record sheets, a display unit (e.g., a liquid crystal panel) for displaying the print sample of the selected record sheet, and a switch for selecting an ink jetting quantity by picking up a proper image quality from the display thereof.

A print data processing unit 70 processes the print data given from a host computer 80. For example, the print data processing unit 70 converts the print data into image data. An ink jetting quantity calculating unit 73 calculates ink jetting quantity control data corresponding to the ink jetting quantity designated by the operation panel 72. A head control unit 74 generates the above-described drive waveform in accordance-with the ink jetting quantity control data, and controls a printer printing unit 75 in accordance with the print data. The printer printing unit 75 is defined as the ink jet head described above.

An operation thereof will be explained. The print data processing unit 70 creates entire or some parts of image to be printed in conformity of a command input from the host computer 80. The ink jetting quantity calculating unit 73 calculates the ink jetting quantity in accordance with this image. The head control unit 74 generates the drive waveform corresponding to the ink jetting quantity and executes printing by controlling the printer printing unit 75.

On this occasion, an operator inputs the type of the sheet to be used, from the operation panel 72. The print sample for the inputted sheet is thereby read from the image file 71. This print sample is displayed on the display unit of the operation panel 72. If the sheet is designated to, e.g., the reproduced paper, there are displayed three print samples when the ink quantity is "small", "intermediate" and "large" in the case of the reproduced paper shown in FIG. 23A. Further, if the sheet is designated to the coat paper, there are displayed the three print samples when the ink quantity is "small", "intermediate" and "large" in the case of the coat paper shown in FIG. 23B.

The operator selects a favorite image quality by seeing the display content. Then, one of "large", "intermediate" and "small" quantities of the inks is inputted through the switch of the operation panel 72. The ink jetting quantity calculating unit 73 calculates the ink jetting quantity in accordance with the thus selected ink quantity, and controls the head control unit 74.

Referring to FIGS. 23A and 23B, the "intermediate" quantity of the inks is set for the ink jet record sheet. As can be understood from FIGS. 23A and 23B, hairlines and blurs are conspicuous in the case of being set to the "intermediate" quantity of the inks. It can be recognized that the image quality is improved by setting the ink quantity to "small".

Thus, it is feasible to obtain a printed result of the optimal image quality corresponding to the type of the record sheet. The number of types of the record sheets used for the ink jet printer can be thereby increased. Further, the image quality is displayed before printing, and hence a trial print is unnecessary, whereby futilities of the record sheets and the inks can be prevented.

Next, there will be described another print system for obtaining the optimal print state by changing the ink jetting quantity in accordance with the sheet to be used.

Figure 24:
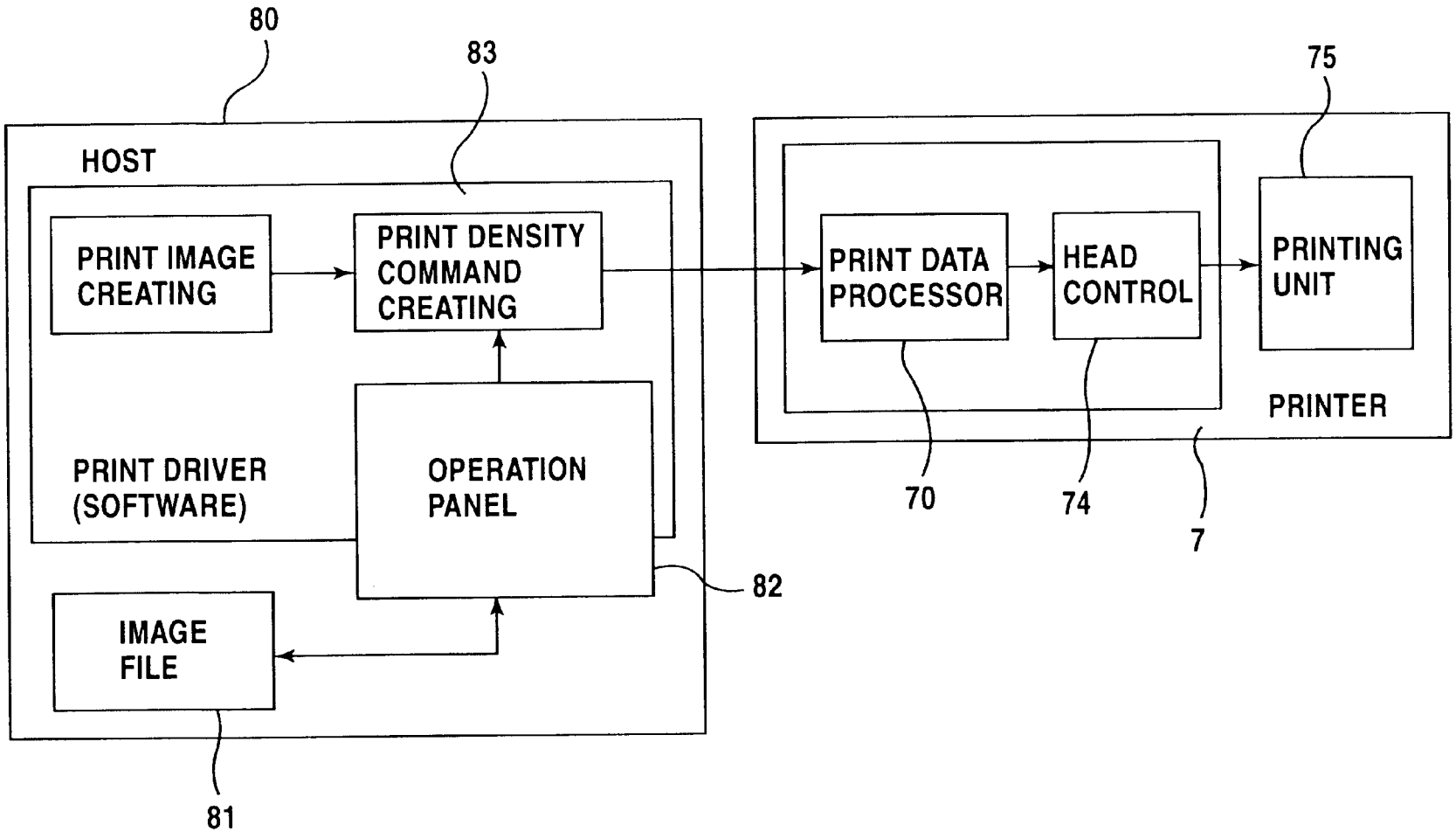
FIG. 24 is an explanatory diagram showing another construction of the print system according to the present invention.
Figure 25A:
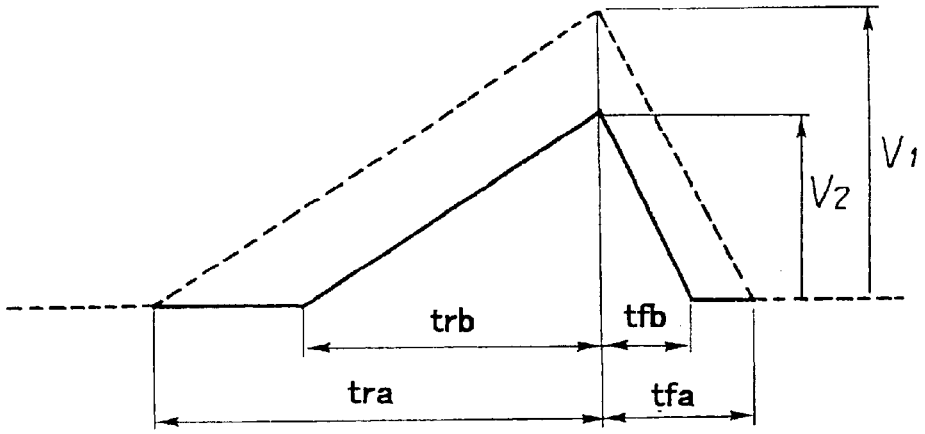
FIG. 25A Prior Art
FIGS. 25A, 25B, 25C and 25D are explanatory diagrams (part 1) showing a first prior art.
Figure 25B:
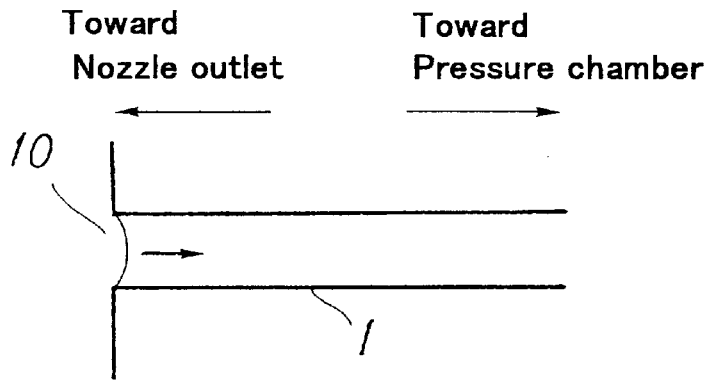
FIG. 25B Prior Art
Figure 25C:
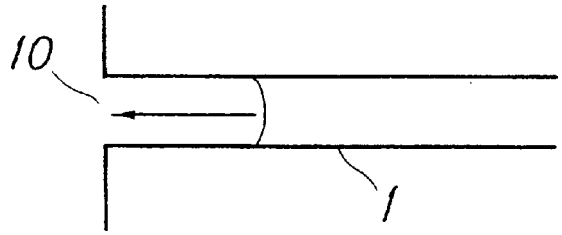
FIG. 25C Prior Art
Figure 25D:
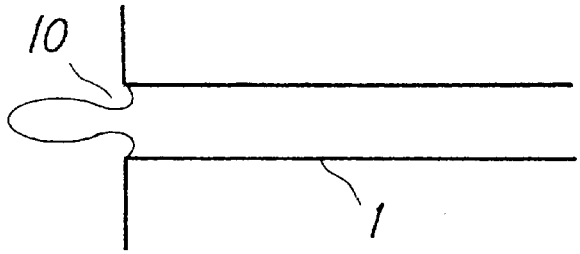
FIG. 25D Prior Art
Figure 26A:
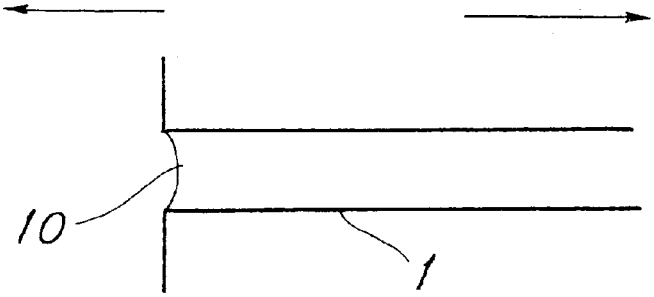
FIG. 26A Prior Art
FIGS. 26A, 26B, 26C, 26D and 26E are explanatory diagrams (part 2) showing the first prior art.
Figure 26B:
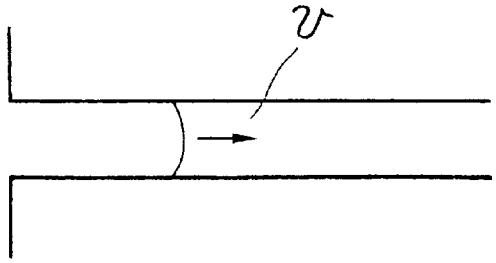
FIG. 26B Prior Art
Figure 26C:
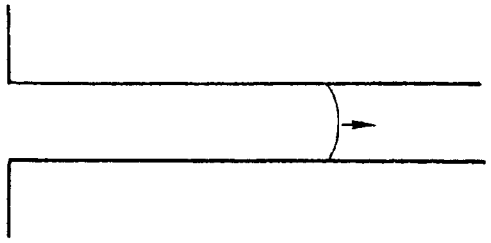
FIG. 26C Prior Art
Figure 26D:
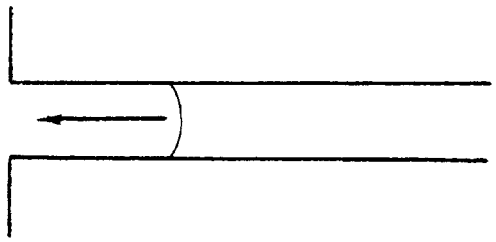
FIG. 26D Prior Art
Figure 26E:
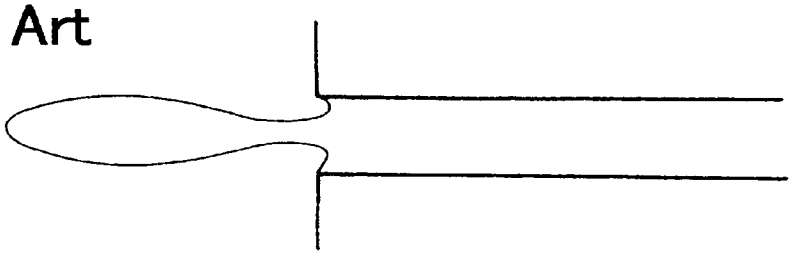
FIG. 26E Prior Art
Figure 27A:
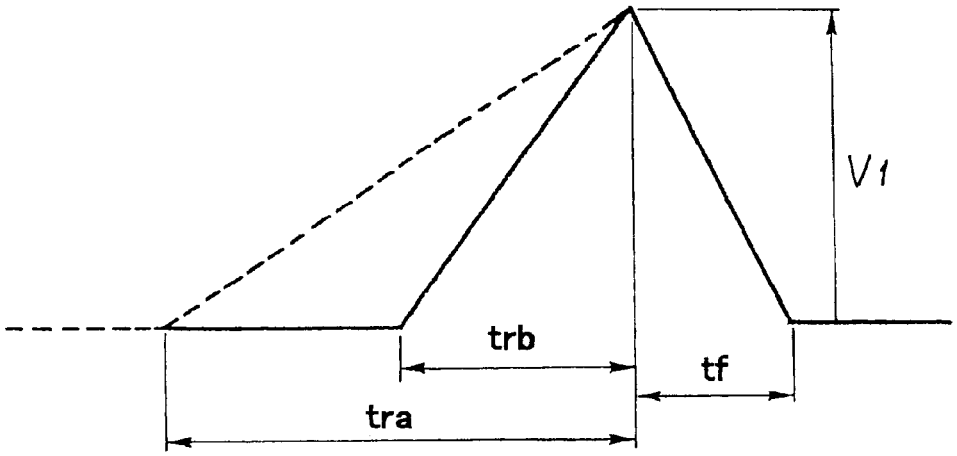
FIG. 27A Prior Art
FIGS. 27A, 27B, 27C and 27D are explanatory diagrams showing a second prior art.
Figure 27B:
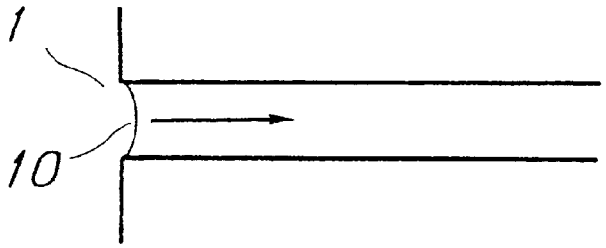
FIG. 27B Prior Art
Figure 27C:
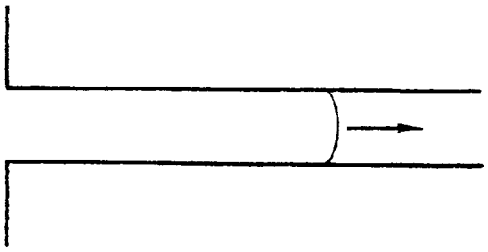
FIG. 27C Prior Art
Figure 27D:
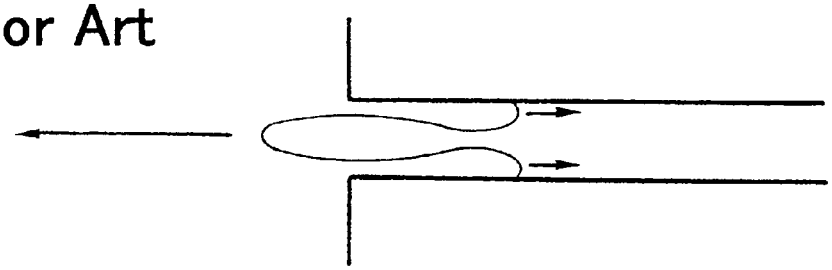
FIG. 27D Prior Art
Figure 28A:
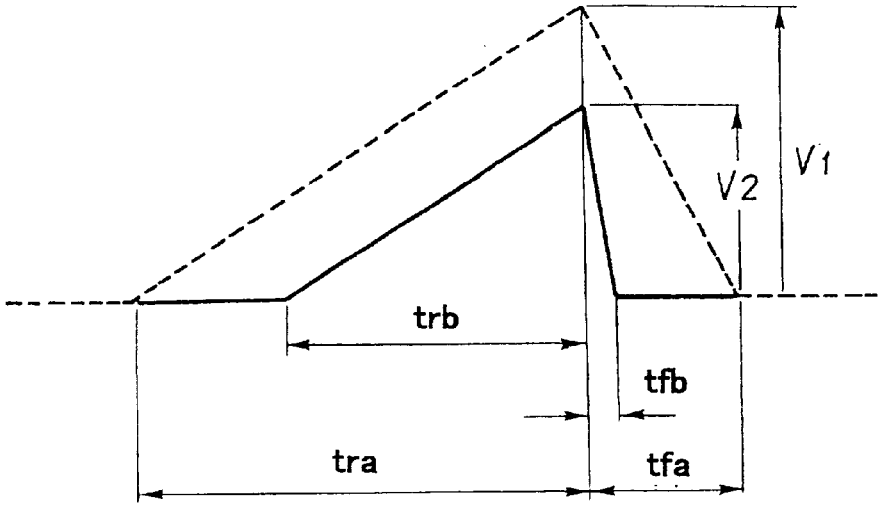
FIG. 28A Prior Art
FIGS. 28A, 28B, 28C and 28D are explanatory diagrams showing a third prior art.
Figure 28B:
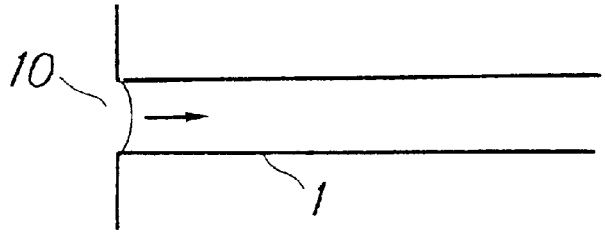
FIG. 28B Prior Art
Figure 28C:
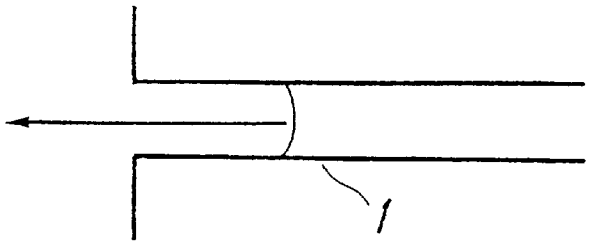
FIG. 28C Prior Art
Figure 28D:
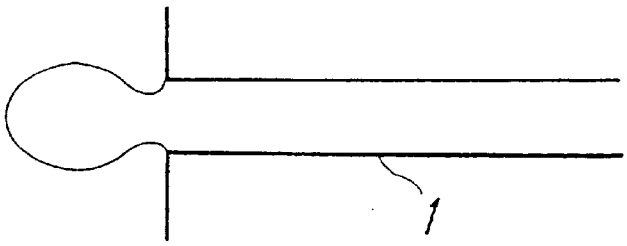
FIG. 28D Prior Art

FIG. 24 is a diagram illustrating a construction of another print system according to the present invention.

A host computer 80 is provided with the image file 71 constructed of the ROM or the hard disk. The image file 71 is stored with the print samples when printed on a typical record sheet. For example, as illustrated in FIG. 23A, there is prepared the print sample of being printed on the reproduced paper in the case of setting the ink quantity to "large", "intermediate" and "small". As illustrated in FIG. 23B, there is prepared the print sample of being printed on the coat paper in the case of setting the ink quantity to "large", "intermediate" and "small".

An operation panel 82 comprises a switch for selecting types of the record sheets, a display unit (e.g., a monitor display) for displaying the print sample of the selected record sheet, and a switch for selecting an ink jetting quantity by picking up a proper image quality from the display thereof.

A printer driver (software) 83 incorporates a print image creating function and a print density command creating function. The print image creating function creates the print image of the printer. The print density command creating function creates a command of the print density of the printer in accordance with an indication of the ink jetting quantity from the operation panel 82.

The print data processing unit 70 processes the print data (including the ink jetting quantity) given from the printer driver 83 of the host computer 80. The head control unit 74 generates the above drive waveform on the basis of the ink jetting quantity control data, and controls the printer printing unit 75 on the basis of the print data. The printer printing unit 75 is defined as the ink jet head described above.

An operation thereof will be explained. The print data processing unit 70 creates entire or some parts of image to be printed on the basis of the print data from the host computer 80. The head control unit 74 generates the drive waveform corresponding to the ink jetting quantity and executes printing by controlling the printer printing unit 75.

In advance of this processing, the operator inputs the type of the sheet to be used, from the operation panel 82. The print sample for the inputted sheet is thereby read from the image file 81. This print sample is displayed on the display unit (a monitor) of the operation panel 82. If the sheet is designated to, e.g., the reproduced paper, there are displayed three print samples when the ink quantity is "small", "intermediate" and "large" in the case of the reproduced paper shown in FIG. 23A. Further, if the sheet is designated to the coat paper, there are displayed the three print samples when the ink quantity is "small", "intermediate" and "large" in the case of the coat paper shown in FIG. 23B.

The operator selects a favorite image quality by seeing the display content. Then, one of "large", "intermediate" and "small" quantities of the inks is inputted through the switch of the operation panel 82. The print density command creating function of the printer driver 83 creates the print density command (the ink jetting quantity) in accordance with the selection of the ink quantity. Then, the print density command is outputted together with the print data to the printer 7.

Thus, the printed result exhibiting the optimal image quality corresponding to the type of the record sheet can be obtained. The number of types of the record sheets used for the in jet printer can be thereby incremented. Further, the trial print or the like is unnecessary because of displaying the image quality before printing. Moreover, the host computer holds the sample images requiring a large storage capacity, and hence the printer body is not required to have a large capacity memory.

In addition to the embodiments discussed above, the present invention can be modified as follows:

(1) The driving method has been described by way of the three embodiments. For instance, however, a combination of the second embodiment with the third embodiment can be carried out.

(2)The ink jet head has been explained by way of the heads shown in FIGS. 2 and 11 but may be applied to other forms.

The present invention has been discussed so far by way of the embodiments. A variety of modifications can be carried out within the range of the gist of the present invention, and these modifications are not excluded from the scope of the present invention.

As explained above, the present invention exhibits the following effects.

(1) The movement quantity of the meniscus is fixed when sucking the inks, and hence it is feasible to prevent a disturbance of scatter of the ink particles and the decrease in the velocity.

(2) There is controlled the movement quantity when abruptly moving the meniscus toward the outlet of the nozzle at the time of jetting out the inks, and therefore the variation width of the ink particle quantity can be enlarged.

What is claimed is:

1. A method of driving a piezo-electric type ink jet head for changing a volume of ink particles to be jetted, said piezo-electric type ink jet head having a pressure chamber for reserving inks, a nozzle for jetting out the ink particles from said pressure chamber and a piezo-electric element for supplying said pressure chamber with a pressure for jetting out the ink particles, said method comprising, before jetting out each particle:

a first step of driving said piezo-electric element so that a meniscus of inks is receded from an initial position of said nozzle to a first position within said nozzle;

a second step of driving said piezo-electric element so that the meniscus advances from the first position to a second position within said nozzle, thereby changing a movement quantity of the meniscus from the first position to the second position in accordance with a particle size of the ink particles to be jetted; and a third step of driving said piezo-electric element so that the meniscus advances from the second position to the initial position more slowly than in the second step.

2. The method of driving the piezo-electric type ink jet head according to claim 1, further comprising:

a fourth step, provided between said first step and said second step, of driving said piezo-electric element so that the meniscus slows down in the first position for a predetermined time.

3. The method of driving the piezo-electric type ink jet head according to claim 2, further comprising:

a fifth step, provided between said second step and said third step, of driving said piezo-electric element so that the meniscus slows down in the second position for a predetermined time.

4. The method of driving the piezo-electric type ink jet head according to claim 1, further comprising:

a fourth step, provided between said second step and said third step, of driving said piezo-electric element so that the meniscus slows down in the second position for a predetermined time.

5. The method of driving the piezo-electric type ink jet head according to claim 1, wherein said second step is a step of changing a moving velocity of the meniscus from the first position to the second position in accordance with a particle quantity of the ink particles to be jetted.

6. The method of driving the piezo-electric type ink jet head according to claim 5, wherein said second step is a step of increasing the moving velocity of the meniscus from the first position to the second position in accordance with the reduction in the particle quantity of the ink particles to be jetted.

7. The method of driving the piezo-electric type ink jet head according to claim 1, wherein said second step is a step of reducing the movement quantity of the meniscus from the first position to the second position in accordance with a reduction in the particle quantity of the ink particles-to be jetted.

8. The method of driving the piezo-electric type ink jet head according to claim 1, wherein said first step is a step of applying a first drive voltage having a first inclination to said piezo-electric element, said second step is a step of applying, to said piezo-electric element, a second drive voltage having a second steep inclination in a direction opposite to the first inclination, and said third step is a step of applying, to said piezo-electric element, a third drive voltage having a third inclination more gentle than the second inclination.

9. The method of driving the piezo-electric type ink jet head according to claim 8, wherein a polarity of said third drive voltage is the same as the polarity of said second drive voltage.

10. A method of driving a piezo electric ink jet head having a pressure chamber for reserving inks, a nozzle for jetting out ink particles from said pressure chamber and a piezo electric element for supplying said pressure chamber with a pressure for jetting out the ink particles, said method comprising:

a step of applying a first oblique drive signal having a first inclination to said piezo-electric element, a step of applying a second oblique drive signal having a second inclination in a direction opposite to the first inclination to said piezo-electric element, and a step of applying a third oblique drive signal having a third inclination more gentle than the second inclination to said piezo-electric element.

11. The method of driving a piezo-electric ink jet head according to claim 10, wherein a polarity of said third oblique drive signal is the same as the polarity of said second oblique drive signal.

12. A driving circuit for driving a piezo-electric type ink jet head having a pressure chamber for reserving inks, a nozzle for jetting out ink particles from said pressure chamber and a piezo electric element for supplying said pressure chamber with a pressure for jetting out the ink particles, said circuit comprising:

a signal generator for generating a first oblique drive signal having a first inclination, a second oblique drive signal having a second inclination in a direction opposite to the first inclination, and a third oblique drive signal having a third inclination more gentle than the second inclination; and a driver for applying said generated drive signals to said piezo-electric element.

13. The driving circuit according to claim 12, wherein said signal generator generates the third oblique drive signal of which a polarity is the same as a polarity of said second oblique drive signal.

14. A method of driving an ink jet head for jetting out ink particles, comprising:

a step of detecting a temperature of said ink jet head;

a step of determining an amplitude data in accordance with said detected temperature;

a step of generating an amplitude voltage having an amplitude corresponding to said amplitude data; and a step of D/A converting of waveform digital data to drive signal of said ink jet head having a magnitude in accordance with said amplitude data by using a multiplication type D/A converter given said amplitude voltage as a reference voltage.

15. A driving device for an ink jet head for jetting out ink particles, comprising:

a detector for detecting a temperature of said ink jet head; and a driver for applying a drive signal having a magnitude in accordance with said detected temperature to said ink jet head, and wherein said driver comprises:

an amplitude voltage generator for generating an amplitude voltage having an amplitude corresponding to an amplitude data determined in accordance with said detected temperature; and a multiplication D/A converter for converting waveform digital data to drive signal of said ink jet head having a magnitude in accordance with said amplitude data by using said amplitude voltage as a reference voltage.

16. A method of driving an ink jet head for jetting out an ink particle, comprising:

a step of selecting a recording mode;

a step of selecting a volume of said ink particle in accordance with a selected recording mode; and a step of applying a drive signal for jetting out said selected volume of said ink particle to said ink jet head.

17. The method of driving according to claim 16, wherein said recording mode selecting step comprises a step of manually selecting the recording mode.

18. The method of driving according to claim 16, wherein said recording mode selecting step comprises a step of selecting a recording medium type to be printed by said ink particle.

19. The method according to claim 16, wherein said selecting step comprises a step of selecting a waveform of said drive signal.

20. An apparatus for driving an ink jet head for jetting out ink particles, comprising:

a selector for selecting a recording mode;

a signal generator for generating a drive signal for jetting out said ink particles which has a volume in accordance with a selected recording mode; and a driver for applying said selected drive signal to said ink jet head.

21. The apparatus according to claim 20, wherein said selector comprises a manual selector for manually selecting the recording mode.

22. The apparatus according to claim 20, wherein said selector comprises means for selecting a recording medium type to be printed by said ink particles.

23. The apparatus of claim 20, wherein said signal generator generates a waveform according to said drive signal.

24. A driving device for an ink jet head for jetting out ink particles, comprising:

a print control circuit for determining an amplitude data;

an amplitude voltage generator for generating an amplitude voltage having an amplitude corresponding to said amplitude data; and a multiplication D/A converter for converting waveform digital data to drive signal of said ink jet head having a magnitude in accordance with amplitude data by using said amplitude voltage as a reference voltage.

25. The driving device of claim 24, wherein said amplitude voltage generator comprises a multiplication D/A converter for converting said amplitude data to said amplitude voltage.

* * * * *